US008353544B2

(12) United States Patent
Fiedler

(10) Patent No.: US 8,353,544 B2
(45) Date of Patent: Jan. 15, 2013

(54) LOCKING MAGNET CLOSURE

(75) Inventor: Joachim Fiedler, Hannover (DE)

(73) Assignee: FIDLOCK GmbH, Hannover (DE)

( * ) Notice: Subject to any disclaimer, the term of this patent is extended or adjusted under 35 U.S.C. 154(b) by 356 days.

(21) Appl. No.: 12/864,728

(22) PCT Filed: Jan. 27, 2009

(86) PCT No.: PCT/DE2009/000090

§ 371 (c)(1),
(2), (4) Date: Jul. 27, 2010

(87) PCT Pub. No.: WO2009/092368

PCT Pub. Date: Jul. 30, 2009

(65) Prior Publication Data

US 2010/0308605 A1 Dec. 9, 2010

(30) Foreign Application Priority Data

Jan. 27, 2008 (DE) ..... 10 2008 006 135
Jan. 23, 2009 (DE) ..... 10 2009 006 003

(51) Int. Cl.

| | |
|---|---|
| ***B65D 27/30*** | (2006.01) |
| ***E05C 17/56*** | (2006.01) |
| ***E05C 19/06*** | (2006.01) |
| ***E05B 15/02*** | (2006.01) |
| ***A44B 1/04*** | (2006.01) |

(52) U.S. Cl. ..... 292/318; 292/251.5; 292/340; 292/80; 292/10; 24/303

(58) Field of Classification Search ..... 292/307 R, 292/318, 1, 10, 80, 251.5, 340; 24/303
See application file for complete search history.

(56) References Cited

U.S. PATENT DOCUMENTS

| | | | | |
|---|---|---|---|---|
| 5,076,623 | A * | 12/1991 | Richards | 292/251.5 |
| 5,572,772 | A * | 11/1996 | Morita | 24/303 |
| 6,009,601 | A * | 1/2000 | Kaufman | 24/303 |
| 6,023,951 | A * | 2/2000 | Maurer et al. | 70/57.1 |
| 6,295,702 | B1 * | 10/2001 | Bauer | 24/303 |
| 6,594,871 | B2 * | 7/2003 | Hoffman | 24/303 |
| 6,717,774 | B2 * | 4/2004 | Hanada et al. | 360/256.1 |
| 6,929,291 | B2 * | 8/2005 | Chen | 292/251.5 |
| 6,978,521 | B2 * | 12/2005 | Morita | 24/303 |
| 7,583,500 | B2 * | 9/2009 | Ligtenberg et al. | 361/679.27 |
| 7,775,567 | B2 * | 8/2010 | Ligtenberg et al. | 292/251.5 |
| 2010/0283269 | A1 | 11/2010 | Fiedler | |

FOREIGN PATENT DOCUMENTS

| | | | |
|---|---|---|---|
| WO | 2008006357 | A2 | 1/2008 |
| WO | 2009006888 | A2 | 1/2009 |

* cited by examiner

*Primary Examiner* — Thomas Beach
*Assistant Examiner* — Nathan Cumar
(74) *Attorney, Agent, or Firm* — The Web Law Firm

(57) ABSTRACT

A locking magnet closure consists of a first closure module and a second closure module and comprises a magnet-keeper construction with at least one magnet in the first closure module and a keeper or second magnet in the second closure module, wherein on closing the magnet-keeper construction pulls the first closure module and the second closure module together in a closing direction. The closure further comprises a locking device for positively locking the closure modules between the first closure module and the second closure module. The locking device comprises at least one spring locking element, consisting of an engaging protrusion and a spring, wherein the spring locking element is arranged in the first closure module, and a locking piece which is arranged in the second closure module.

11 Claims, 35 Drawing Sheets

Schnitt A-A

LOCKING MAGNET CLOSURE

CROSS-REFERENCE TO RELATED APPLICATIONS

This application is a National Phase Patent Application of International Patent Application Number PCT/DE2009/000090, filed on Jan. 27, 2009, which claims priority of German Patent Application Number 10 2008 006 1352, filed on Jan. 27, 2008, and German Patent Application Number 10 2009 006 003.0, filed on Jan. 23, 2009.

BACKGROUND OF THE INVENTION

Field of the Invention

This invention relates to a closure for closing preferably handbags, furniture, doors and comparable articles of daily use. For these applications, a wide variety of closure constructions are known from the prior art. These closures are actuated by hand and have a resilient closing engagement, wherein the closure halves are brought together by means of a force applied by hand. In doing so, the force of a spring must be overcome, until the engaging elements snap together. The spring positively holds the engaging elements together in an undercut.

An essential feature of closures which are actuated by hand is the so-called haptics. In the following, good haptics is understood to be the property of the closure that in terms of its application the closure can be actuated particularly easily.

Closures which have a particularly good haptics are described in the document WO 2008/006357.

SUMMARY OF THE INVENTION

According to constructions which have become known so far, such closures still are relatively large and heavy and require a relatively large magnet. Therefore, a constant need exists to improve these closures and provide constructions which allow a smaller construction volume and the use of smaller magnets, whereby the costs are also lowered.

The article in accordance with the invention as claimed in claim 1 consists of a first closure module and a second closure module for connecting two elements, wherein one of the closure modules each can be attached to each element or the closure modules form an integral unit with the elements.

The closure modules have the following characteristics: a magnet-keeper construction with at least one magnet in closure module 1 and a keeper or second magnet in closure module 2, wherein the magnet-keeper construction is formed such that on closing the closure module 1 and the closure module 2 are automatically pulled together in closing direction X by means of the magnetic force.

Furthermore, the closure module 1 and the closure module 2 are formed such that for opening purposes the closure modules can be rotated or shifted in opening direction Y laterally to the closing direction X.

There is provided a locking device for positively locking the closure modules, wherein the locking device includes at least one spring locking element comprising an engaging protrusion and a spring, and wherein the spring locking element is arranged in the closure module 1. Furthermore, a locking piece is provided, which is arranged in the closure module 2, wherein on closing the locking piece pushes the spring locking element to the side in a direction Z and then positively snaps into place with the engaging protrusion, and when shifting or when rotating closure module 1 and closure module 2 into the opening direction Y, depending on the constructive design, the locking piece and the spring locking element are rotated or shifted against each other from an engagement position, in which locking piece and spring locking element are in engagement, into a non-engagement position, in which locking piece and spring locking element are not in engagement, without the spring locking element being pushed to the side. The magnet-keeper construction is dimensioned such that on closing the locking device is automatically closed by the magnetic force of the magnet-keeper construction.

In accordance with the invention, the spring of the spring locking element is formed and arranged such that it has a dual function:

On closing, the spring deflects flexurally soft in the direction Z, but when applying a load on the closure against the closing direction X the spring is flexurally rigid.

It is known to the skilled person that the cross-sectional geometry and also the shape of a spring influences the flexural rigidity thereof. The invention utilizes this effect and employs a spring or a spring system comprising a plurality of springs, which is formed and arranged such that when closing the closure a load is applied on the spring in the direction in which the spring is flexurally soft, i.e. the spring is shaped and mounted such that on closing the spring can be bent with little force. However, when trying to open the closure opposite to the closing direction, the spring is loaded in a direction in which it is flexurally rigid. This ensures a high locking force of the closure, which mostly is so great that the closure only opens due to the mechanical destruction of the spring.

Corresponding spring geometries are known to the skilled person, and therefore only a few essential geometries will be explained in the embodiments in conjunction with the respective constructive mounting situation.

By utilizing this dual function of the spring, locking magnet closures can be built particularly small and stable.

According to another embodiment, a locking magnet closure is almost identical with the closure described previously, but the opening of the closure is effected according to another principle likewise known from prior art, wherein on shifting or rotating closure module 1 and closure module 2 in opening direction Y the spring locking element is gradually pushed to the side by means of a wedge from an engagement position, in which the locking piece and the spring locking element are in engagement, into a non-engagement position, in which the locking piece and the spring locking element no longer are in engagement with each other.

According to another embodiment, the spring of the spring locking element is a resilient strip bent axially to the closing direction X.

According to another embodiment, the spring of the spring locking element is a resilient strip repeatedly kinked parallel to the closing direction X.

According to another embodiment, the spring is a strip meandrously bent to and fro axially to the direction X or kinked parallel to the direction X.

According to another embodiment, the spring has one or more resilient joints or resilient joint-like thin portions.

According to another embodiment, the spring is configured as a separate component and in the open position held centered in the closure module 2 by means of one or more inner stops.

According to another embodiment, the spring likewise is configured as a separate component and in the open position held centered in the closure module 2 by means of one or more outer stops.

According to another embodiment, the magnet-keeper construction includes an attenuatable magnetic system.

According to another embodiment, the magnet-keeper construction includes a polable magnetic system.

According to another embodiment, a repositioning device is provided, which urges the function elements shifted in direction Y on opening the locking magnet closure back into their starting position. The restoring force can be a mechanical spring force or a weight force. The weight force is produced by means of a mass piece, which on opening the closure is lifted by hand due to the rotary movement. For this purpose, an eccentric can be used for example. If the mass piece is released, it is drawn downwards by the gravitational force, wherein the repositioning device is reset, so that the engagement position is restored.

BRIEF DESCRIPTION OF THE DRAWINGS

The idea of the invention shall subsequently be described with regard to the embodiments shown in the figures. Herein

DETAILED DESCRIPTION OF THE PREFERRED EMBODIMENTS

The invention will subsequently be explained in detail with reference to embodiments and schematic drawings.

FIGS. 1*a-g* show a general embodiment of the invention with opening through a release gap.

Figure 1A:
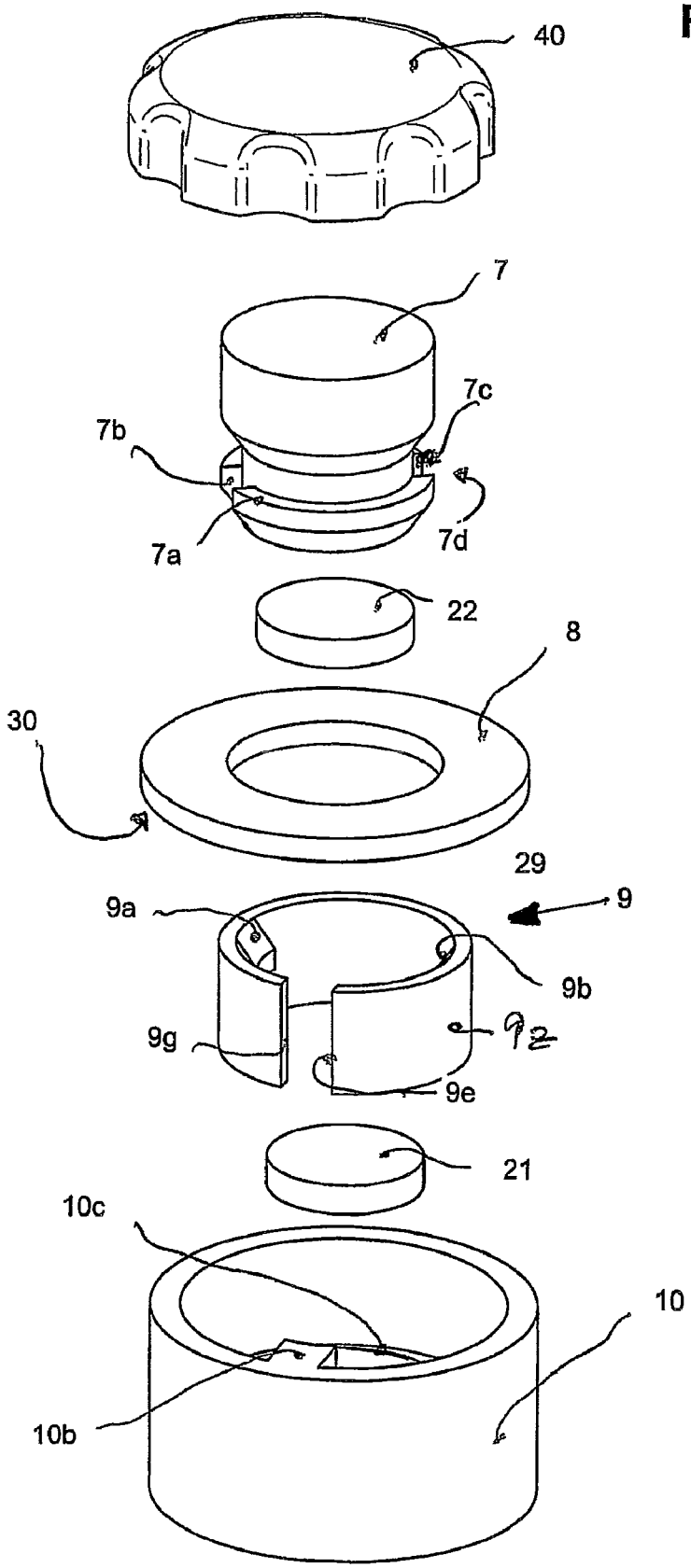
FIGS. 1*a-g* show a general embodiment of a closure with opening through a release gap.

FIG. 1*a* shows all parts of the invention in an exploded representation.

A first connection module consists of: a rotary part 7, a magnet 22 and locking pieces 7*a*, 7*c* which are formed as a circumferential edge.

A second connection module consists of: a housing rim 8, a housing cap 10, a keeper or magnet 21 and a spring locking element 9 of a bent strip-shaped spring 9*z* with the engaging protrusions 9*a*, 9*b*, which rests on the supporting surface 30 of the housing rim with the end face 29.

Between the first connection module and the second connection module a closable and releasable rotary snap-action closure is effected in that the locking pieces 7*a*, 7*c* of the rotary part 7 form a snap-action closure with the beveled engaging protrusions 9*a* and 9*c* protruding from the spring locking element 9.

The spring locking element 9 is non-rotatably positioned by the spring ends 9*c* and 9*g* abutting against the strut 10*b* of the housing cap 10. In addition, the spring locking element 9 is positioned centered in the lower part by the inner stop 10*c*. The spring locking element 9 rests against the bottom surface 30 of the housing rim 8 with the upper end face 29.

Figure 1B:
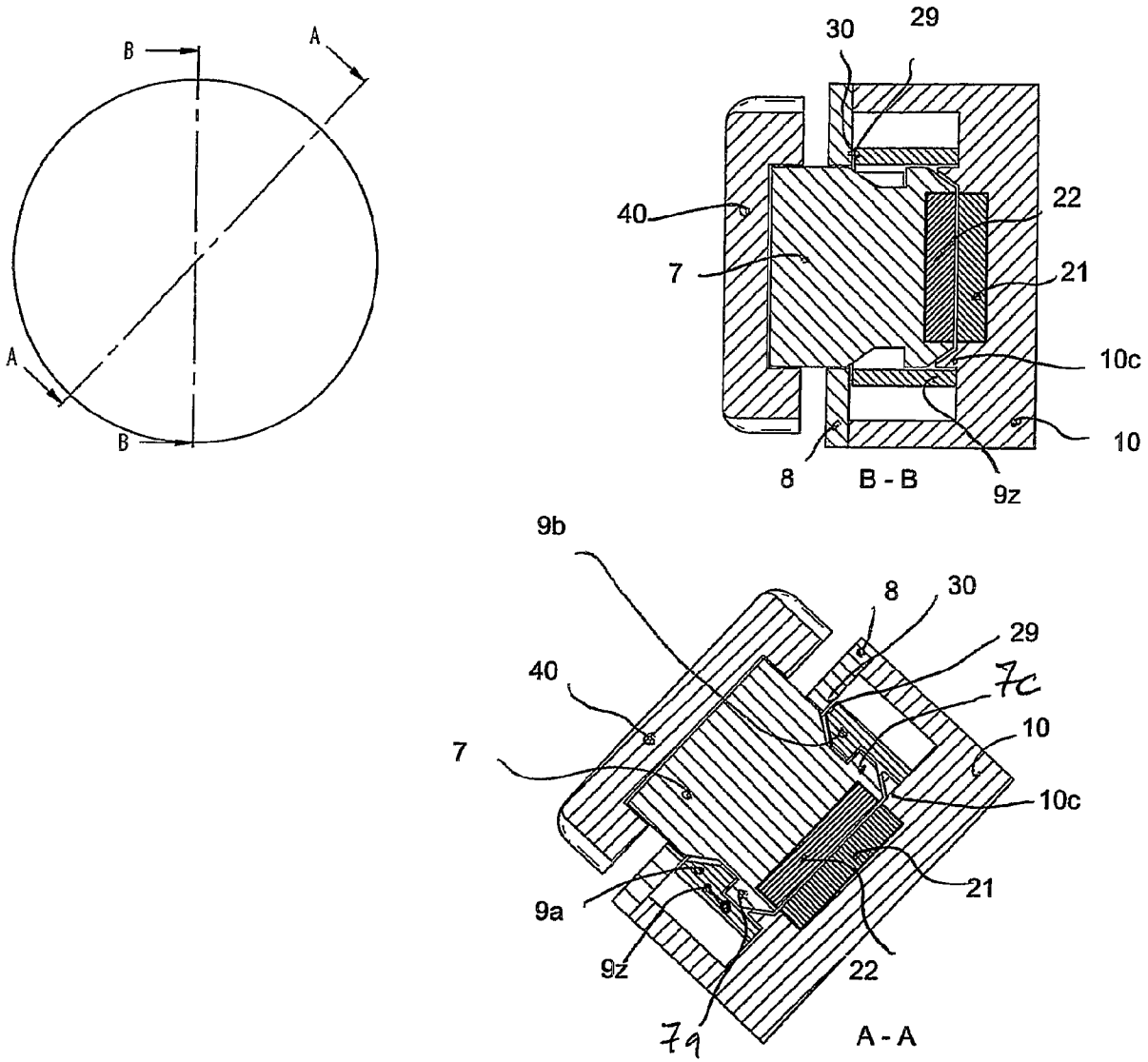
Figure 1C:
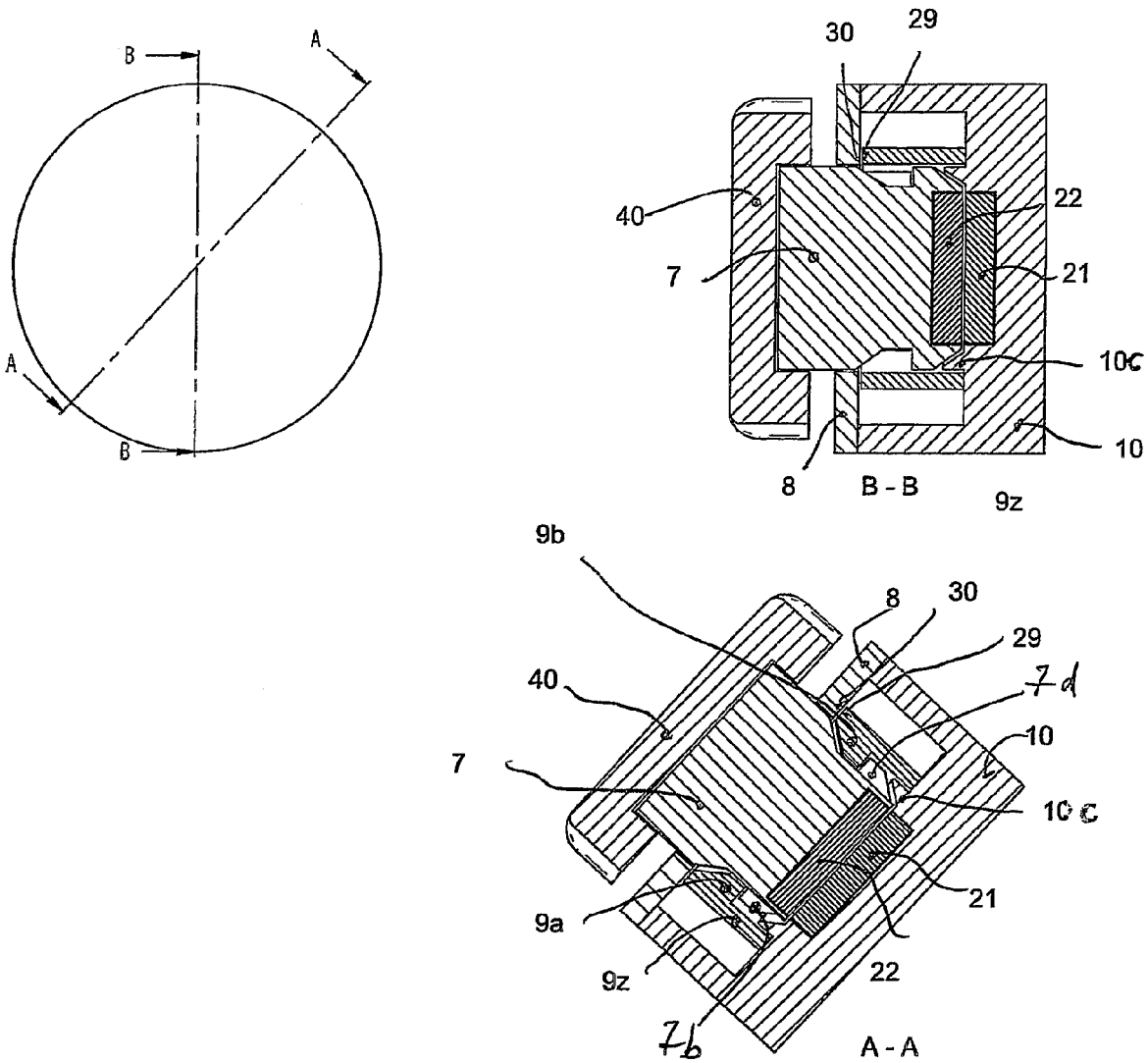

FIG. 1*b* and FIG. 1*c* show the closure of the invention in the sectional views A-A and B-B.

Figure 1D:
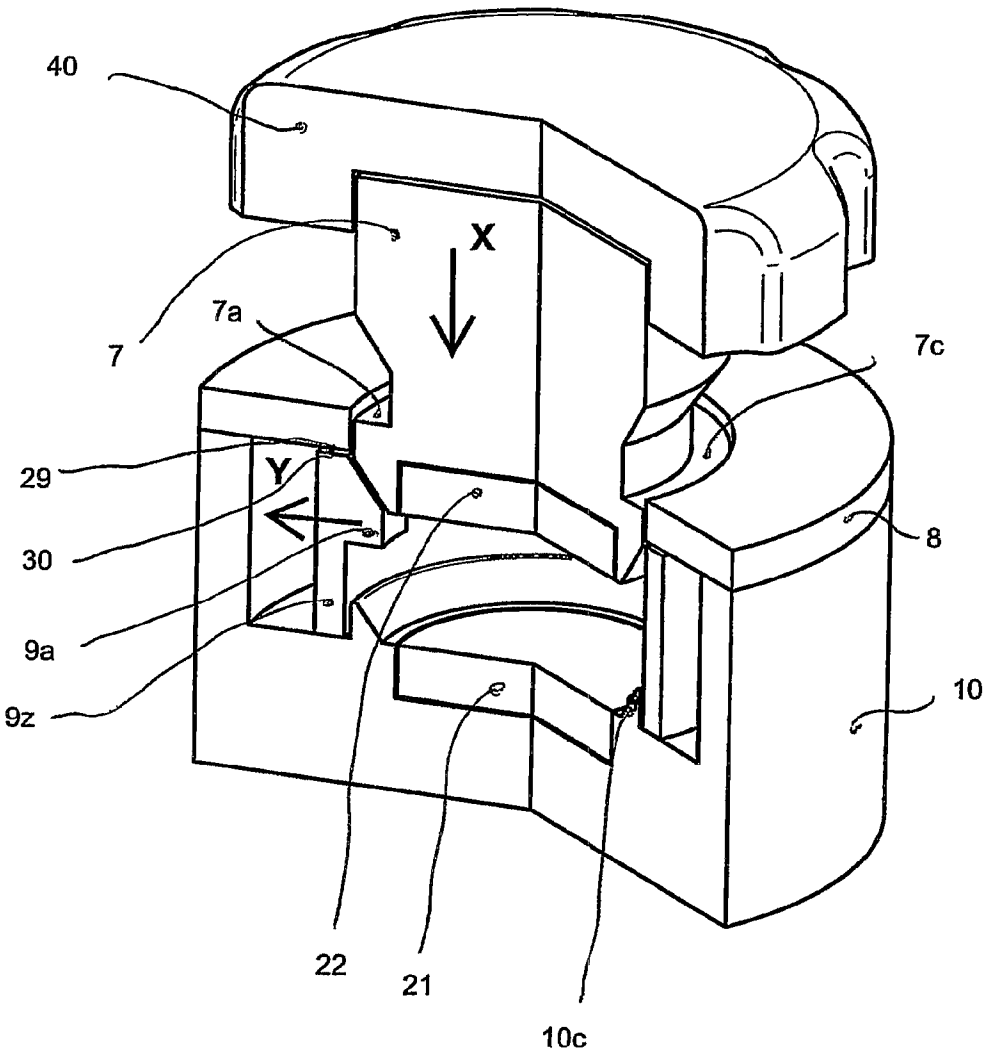
Figure 1E:
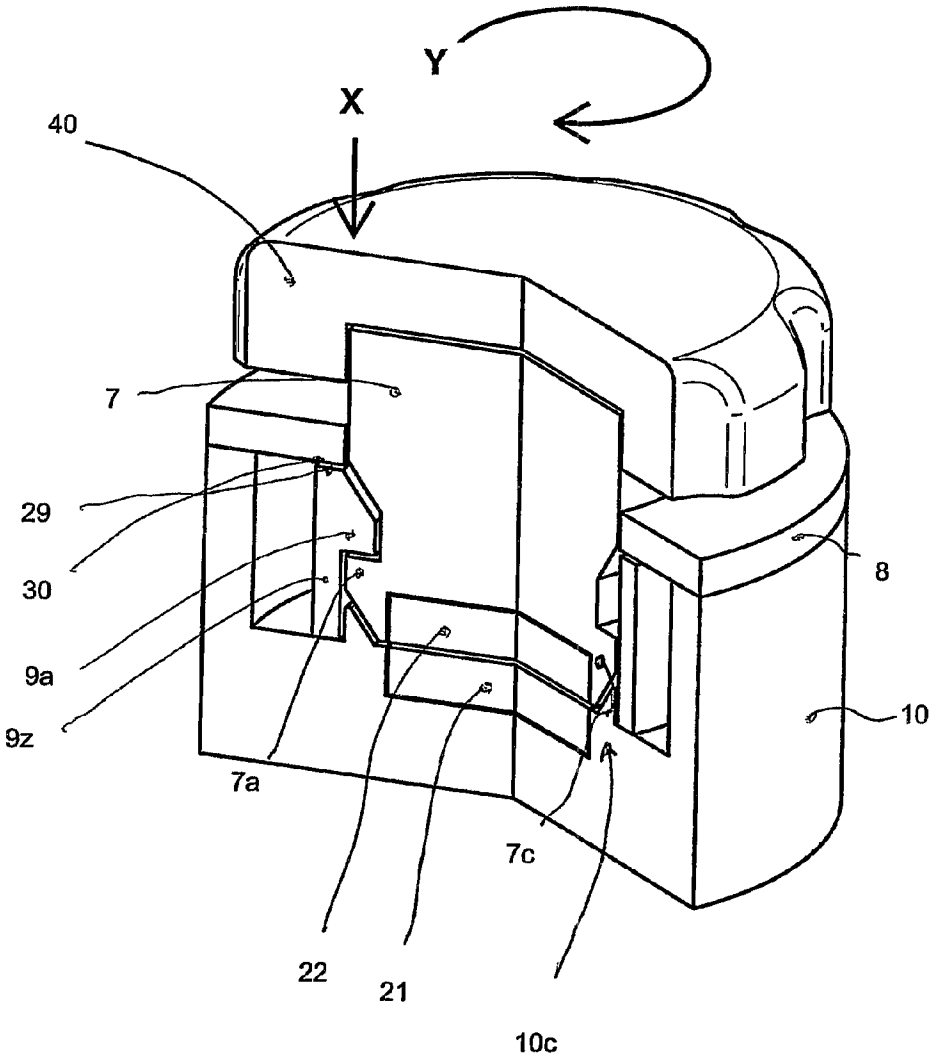

FIG. 1*b* shows the closing position analogous to FIG. 1*e*. Here, the engaging protrusions 9*a*, 9*b* of the spring locking element 9 are in engagement with the locking pieces 7*a*, 7*c*.

Figure 1F:
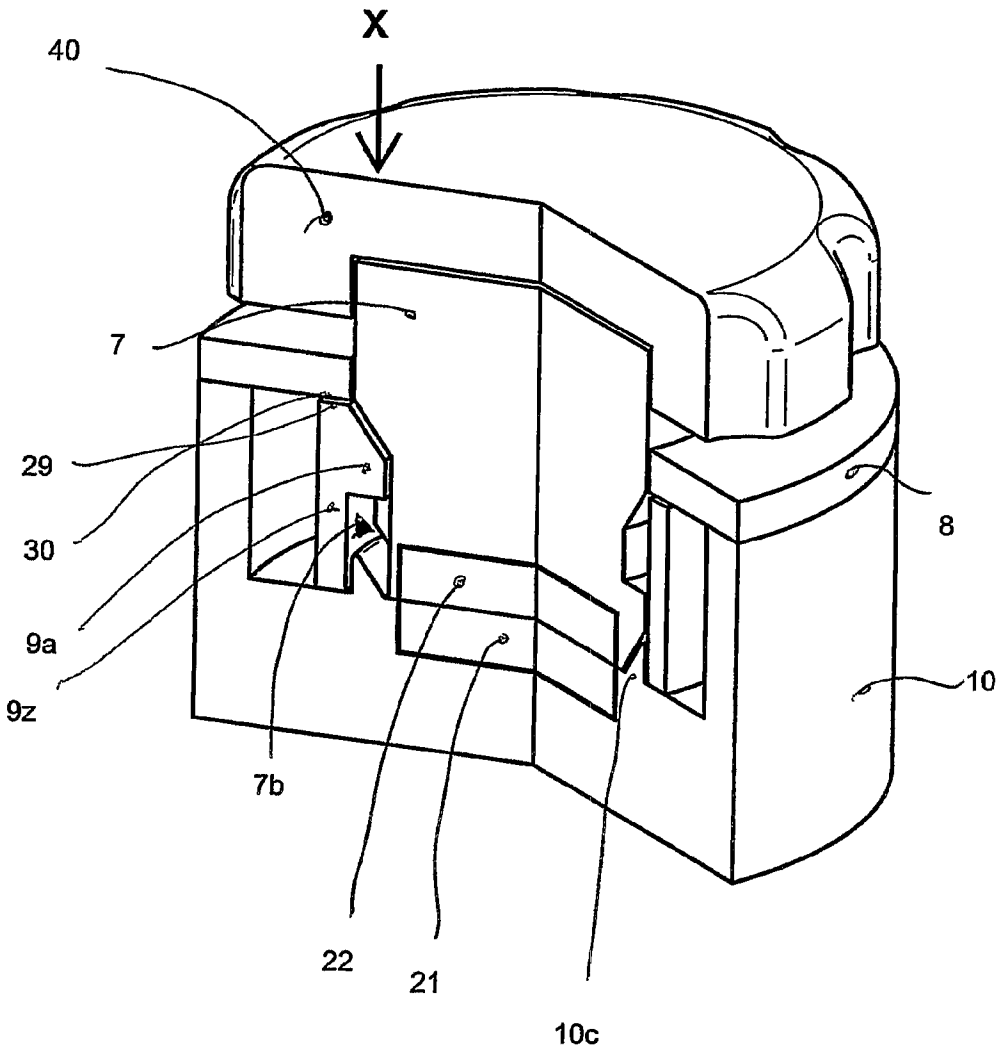

FIG. 1*c* shows the phase after rotation of the connection module 1 in the direction Y analogous to FIG. 1*f*. The connection module 1 has been rotated to such an extent that the engaging protrusions 9*a*, 9*b* of the spring locking element 9 are disposed opposite the gaps between the locking pieces 7*b*, 7*d* and thus are out of engagement with the locking pieces 7*a*, 7*c*.

FIGS. 1*d*-1*g* show the most important functional phases during closing and opening:

FIG. 1*d* shows the closing operation. On closing, connection module 1 and connection module 2 are pulled together in the direction X by the magnet-keeper construction 21, 22. In the process, the engaging protrusions 9*a*, 9*b* of the spring locking element 9 are pushed to the side in the direction Z by the locking pieces 7*a*, 7*c*. In accordance with the invention, the strip-shaped spring 9*z* is particularly flexurally soft in this direction, since the strip can be bent most easily in the direction Z of its thickness, i.e. smallest dimension, so that only the magnetic force of a relatively weak magnet-keeper construction 21, 22 is required to overcome the spring force of the spring 9*z*.

FIG. 1*e* shows the closure in closing position after locking pieces 7*a*, 7*c* and engaging protrusions 9*a*, 9*b* have snapped into place.

When a loading force now acts against the closing direction X, the locking pieces 7*a*, 7*c* press on the engaging protrusions 9*a*, 9*b*. Under great load, the engaging protrusions now want to back away in the direction W and bend the spring 9*z*, as indicated with the broken line. However, since the spring 9*z* already is bent in one direction and an unelastic surface can only be arched in one direction, it now is particularly flexurally rigid in the loading direction opposite to the direction X. Thus, the closure can withstand particularly high loads, so that it can also be built very small with good strength values. Furthermore, it can also be built at low cost, since the magnets can be dimensioned small.

Figure 1G:
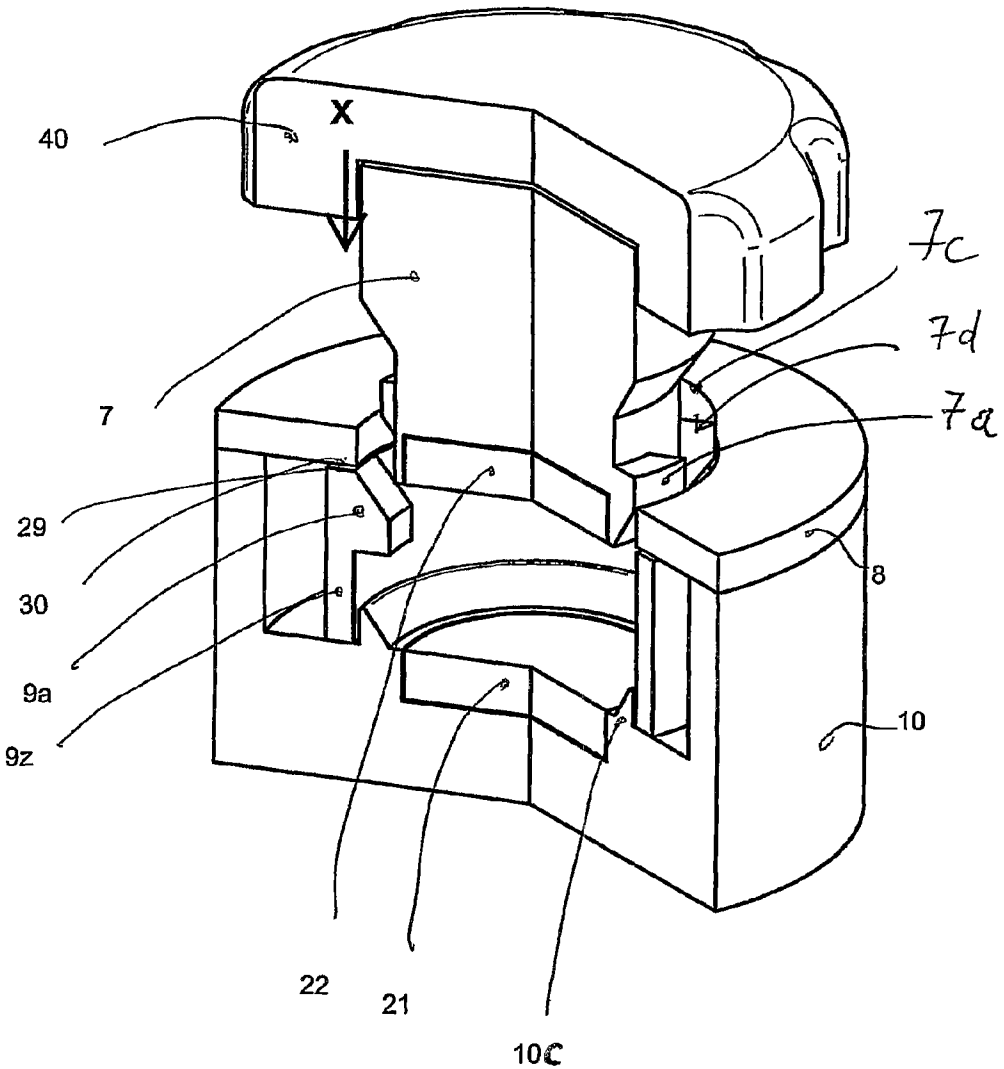

As next functional phase, the connection module 1 now is rotated with the rotary knob 40 axially in direction Y to such an extent that the functional phase according to FIG. 1*f* is reached, in which the connection module 1 has been rotated to such an extent that the engaging protrusions 9*a*, 9*b* of the spring locking element 9 are disposed opposite the gaps between the locking pieces 7*b*, 7*d* and hence are out of engagement with the locking pieces 7*a*, 7*c*. The closure can now be opened, as shown in FIG. 1*g*.

Figure 2:
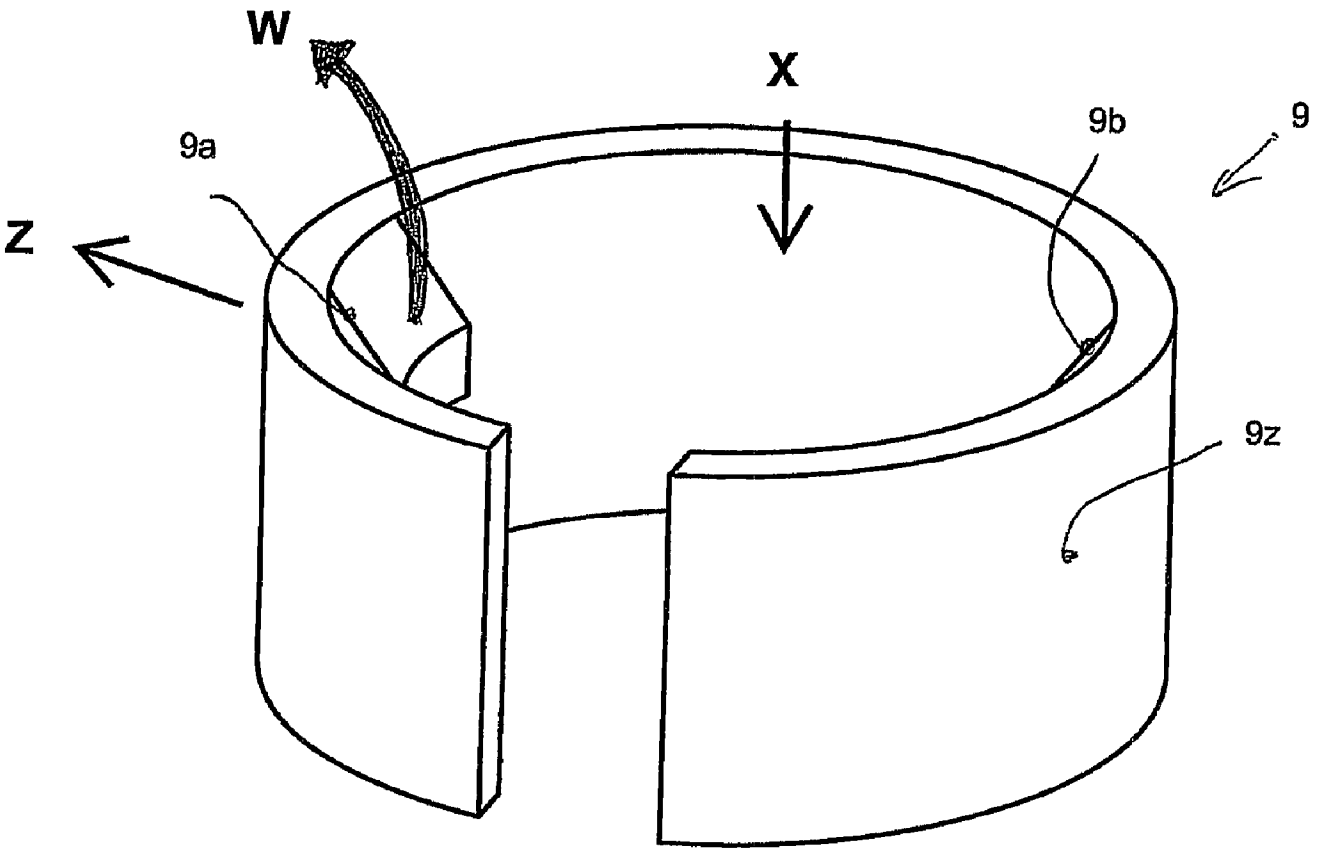
FIG. 2 shows the spring locking element of FIGS. 1*a-g;*

FIG. 2 shows the inventive spring locking element of FIG. 1-*g* according to claims 1 and 2.

Here, the dual function can be seen once again: the strip-shaped spring 9*z* bent axially to the direction X is flexurally soft in direction Z, and when applying a load on the engaging protrusions 9*a*, 9*b* against the direction X, whereby a deflection force W is produced, it is particularly flexurally rigid opposite to the deflection force W.

Figure 3:
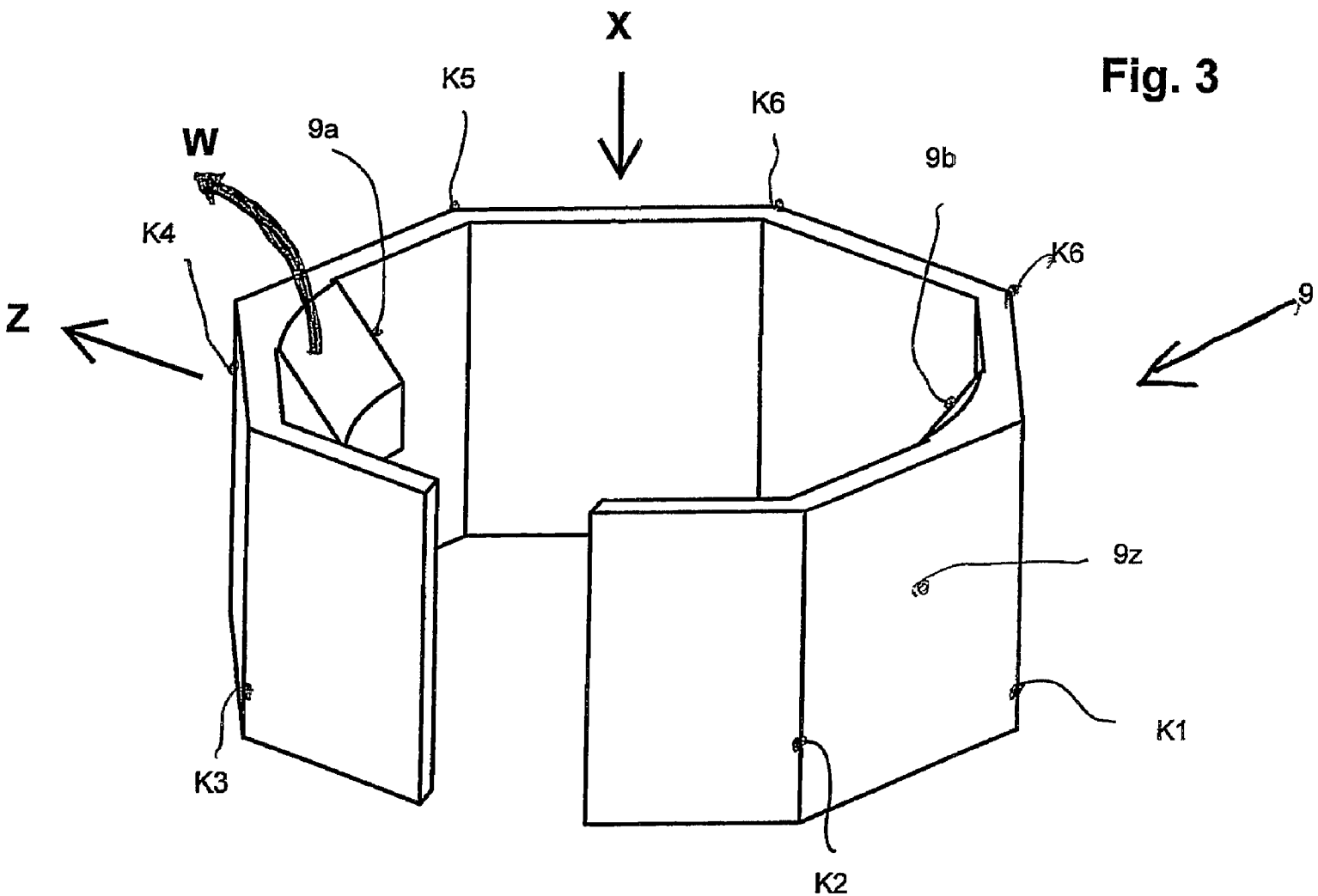
FIG. 3 shows another embodiment of a spring locking element.

FIG. 3 shows a spring locking element in accordance with the invention as claimed in claims 1 and 3.

The strip-shaped spring 9*z* repeatedly kinked parallel to the direction X is flexurally soft in direction Z, and when applying a load on the engaging protrusions 9*a*, 9*b* against the direction X, whereby a deflection force W is produced, it is particularly flexurally rigid opposite to the deflection force W.

Figure 5:
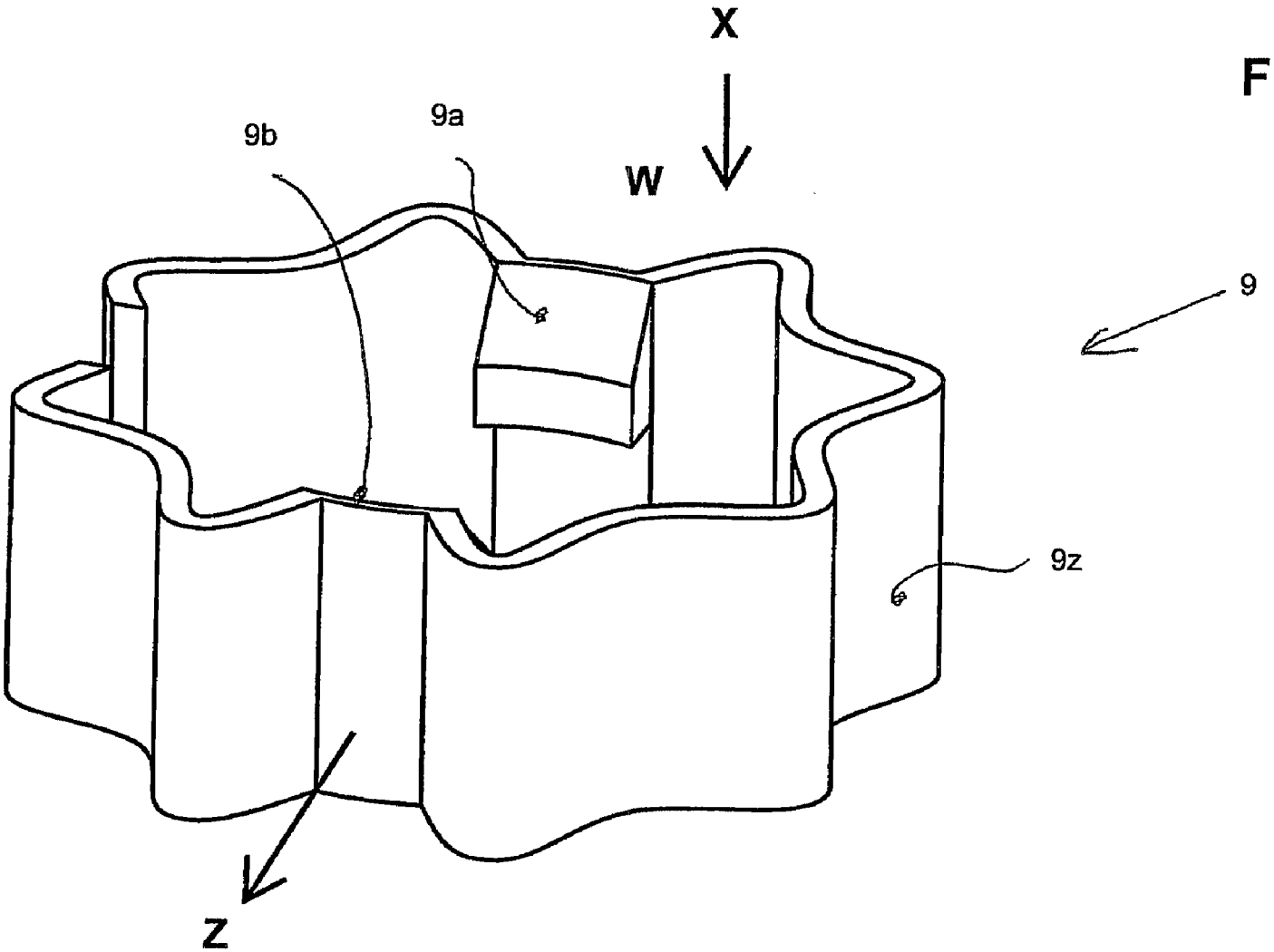
FIG. 5 shows another embodiment of a spring locking element.

FIG. 5 shows a spring locking element in accordance with the invention as claimed in claims 1 and 5.

The strip-shaped spring 9*z* meandrously bent repeatedly to and fro axially to the direction X is flexurally soft in direction Z, and when applying a load on the engaging protrusions 9*a*, 9*b* against the direction X, whereby a deflection force W is produced, it is particularly flexurally rigid opposite to the deflection force W. It is clear to the skilled person that the bends can also be kinks parallel to the direction X.

Figure 6:
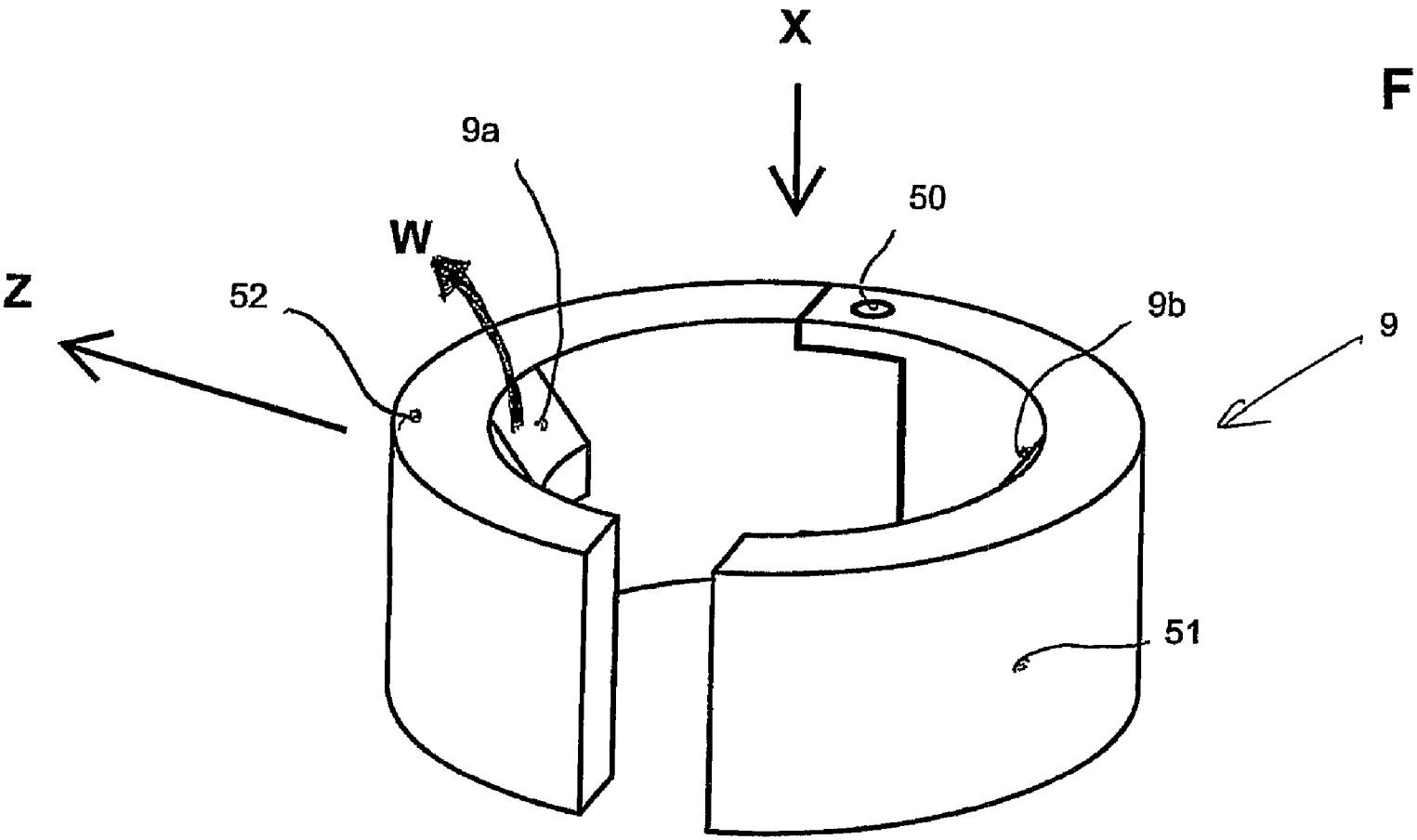
FIG. 6 shows another embodiment of a spring locking element.

FIG. 6 shows a spring locking element in accordance with the invention as claimed in claims 1 and 6.

The spring locking element has a resilient hinge 50 with the hinge axis parallel to the direction X. The side regions 51, 52 are formed particularly stable. As a result, the spring locking element is flexurally soft in direction Z, and when applying a load on the engaging protrusions 9*a*, 9*b* against the direction X, whereby a deflection force W is produced, it is particularly flexurally rigid opposite to the deflection force W.

Figure 7:
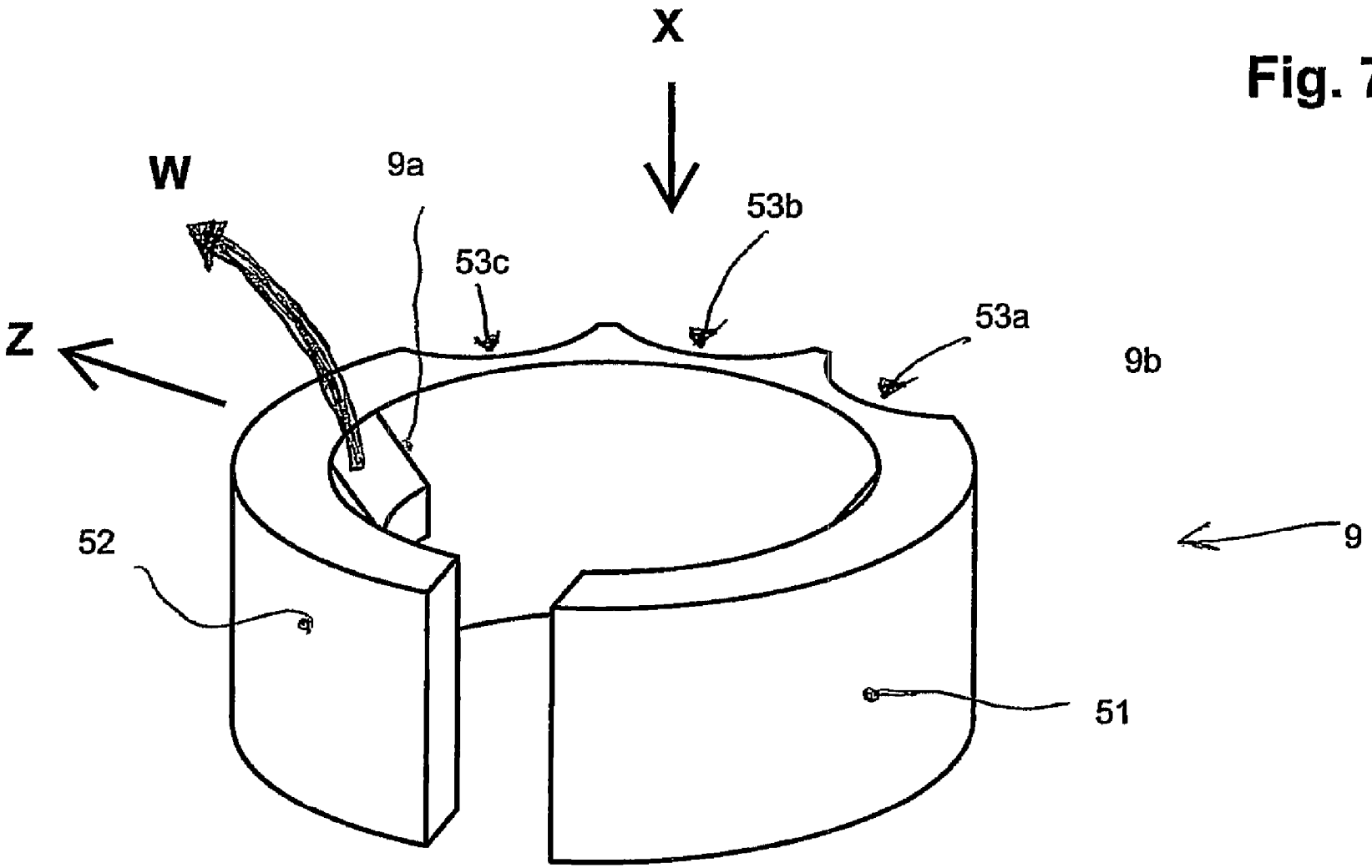
FIG. 7 shows another embodiment of a spring locking element.

FIG. 7 shows a spring locking element in accordance with the invention as claimed in claims 1 and 6.

The spring locking element has a plurality of resilient hinge-like thin portions 53*a*, 53*b*, 53*c* with the hinge axis parallel to the direction X. The side regions 51, 52 are formed particularly stable. As a result, the spring locking element is flexurally soft in direction Z, and when applying a load on the engaging protrusions 9*a*, 9*b* against the direction X, whereby a deflection force W is produced, it is particularly flexurally rigid opposite to the deflection force W.

FIGS. 8*a-e* show an embodiment of the invention as claimed in claim 2, which is very closely related to the first embodiment.

Figure 8A:
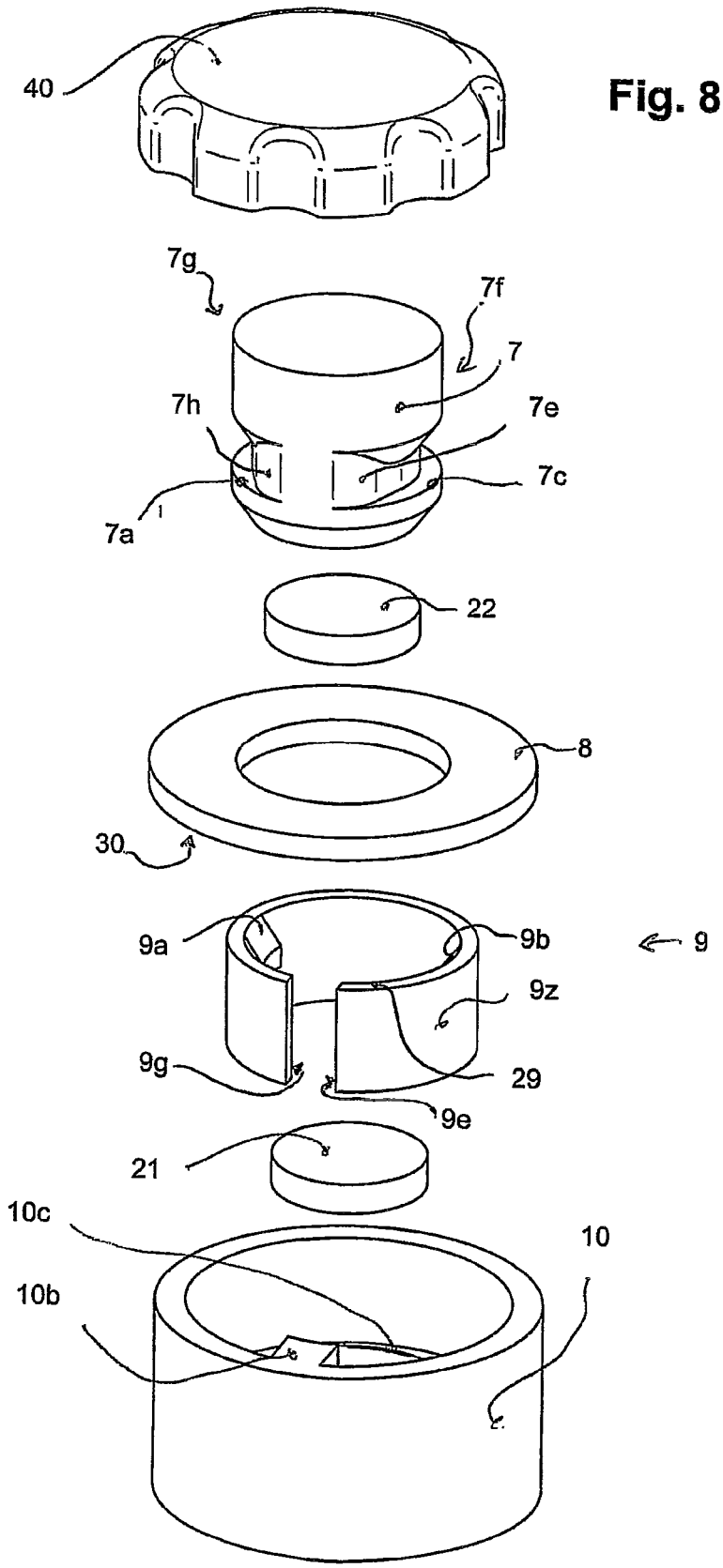
FIGS. 8*a-e* show another embodiment of a closure.

FIG. 8*a* shows all parts of the invention in an exploded representation.

A first connecting module consists of: a rotary part 7, a magnet 22 and locking pieces 7*a*, 7*c* which are formed as a circumferential edge and as wedge-shaped sloping surfaces 7*e*, 7*f*, 7*g*, 7*h*.

A second connection module consists of: a housing rim 8, a housing cap 10, a keeper or magnet 21 and a spring locking element 9 of a bent strip-shaped spring 9*z* with the engaging protrusions 9*a*, 9*b*, which rests on the supporting surface 30 of the housing rim with the end face 29.

Between the first connection module and the second connection module a closable and releasable rotary snap-action closure is effected in that the locking pieces 7*a*, 7*c* of the rotary part 7 form a snap-action closure with the beveled engaging protrusions 9*a* and 9*c* protruding from the spring locking element 9.

The spring locking element 9 is non-rotatably positioned by the spring ends 9*c* and 9*g* abutting against the strut 10*b* of the housing cap 10. In addition, the spring locking element 9 is positioned centered in the lower part by the inner stop 10*c*. The spring locking element 9 rests against the bottom surface 30 of the housing rim 8 with the upper end face 29.

Figure 8B:
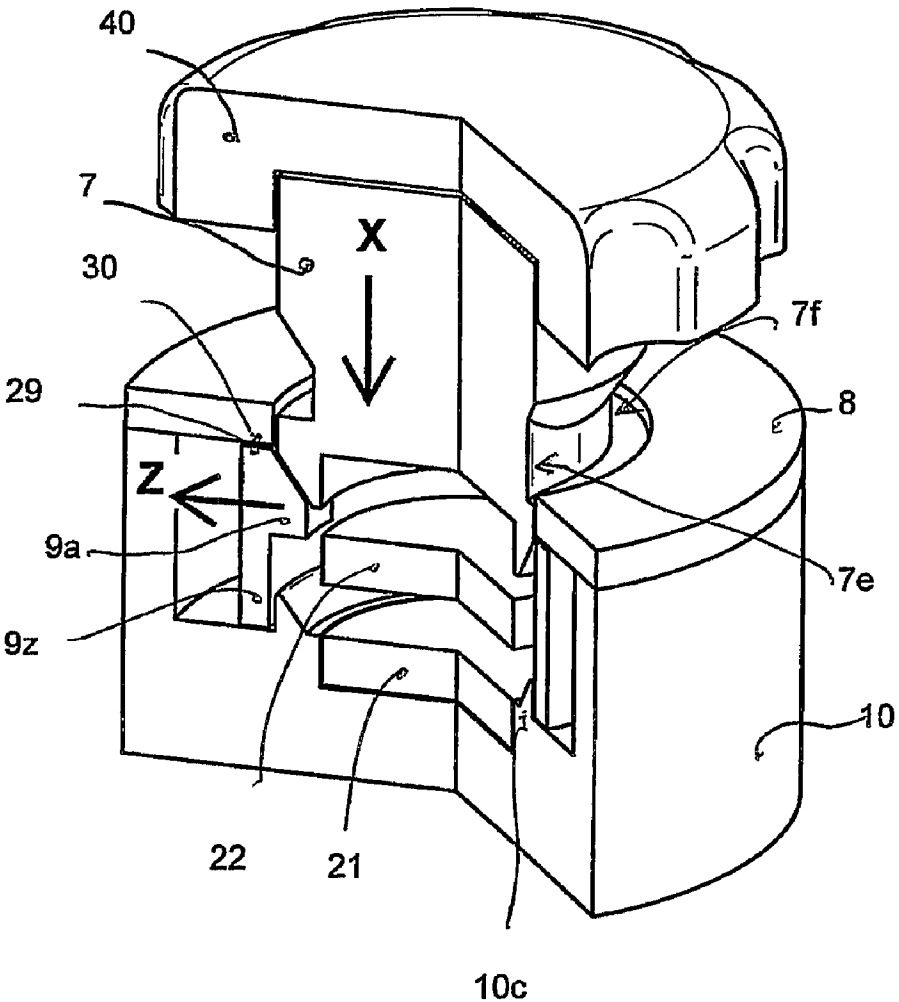

FIGS. 8*b*-8*e* show the most important functional phases during closing and opening:

FIG. 8*b* shows the closing operation. On closing, connection module 1 and connection module 2 are pulled together in the direction X by the magnet-keeper construction 21, 22. In the process, the engaging protrusions 9*a*, 9*b* of the spring locking element 9 are pushed to the side in the direction Z by the locking pieces 7*a*, 7*c*. In accordance with the invention, the strip-shaped spring 9*z* is particularly flexurally soft in this direction, since the strip can be bent most easily in the direction Z of its thickness, i.e. smallest dimension, so that only a relatively weak magnet-keeper construction 21, 22 is required to overcome the spring force of the spring 9*z*.

Figure 8C:
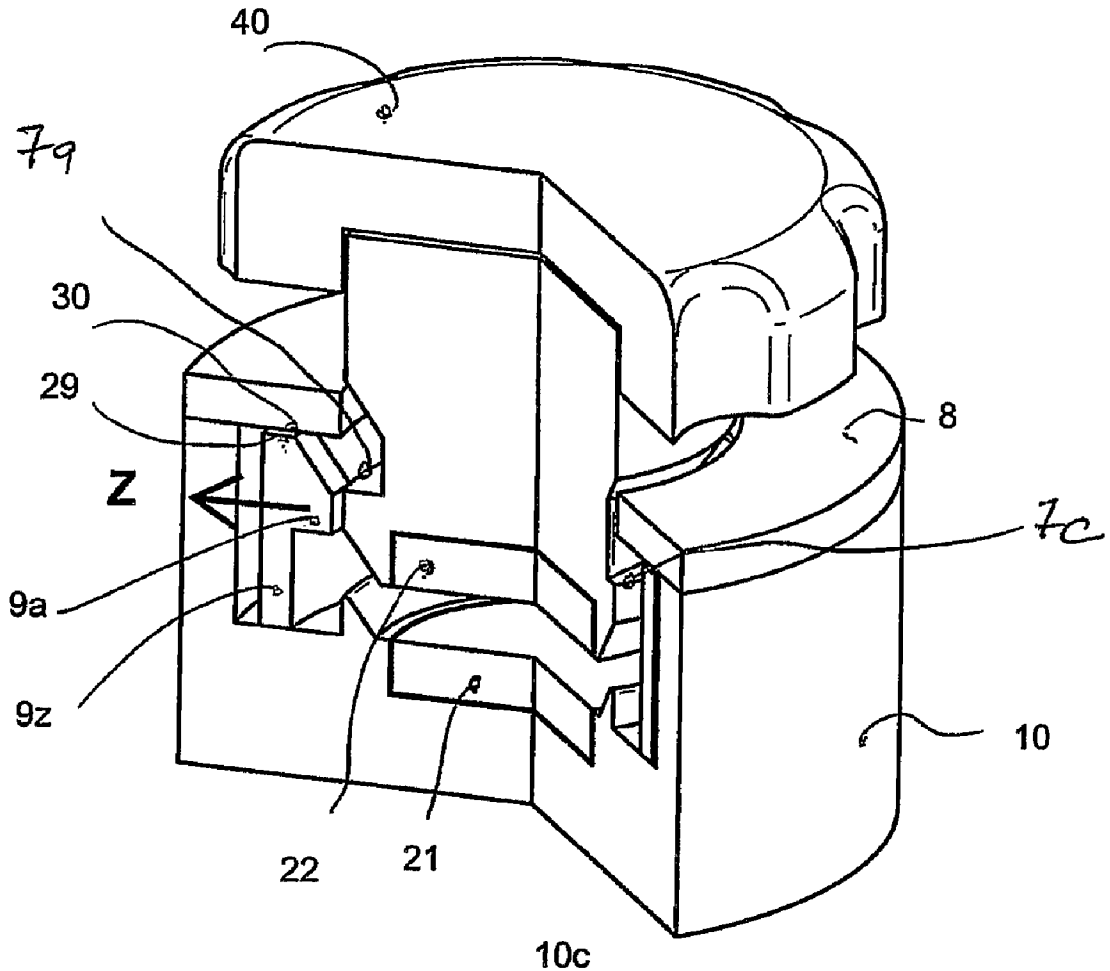

FIG. 8*c* shows the closure during the closing operation, where the engaging protrusions are pushed to the side.

Figure 8D:
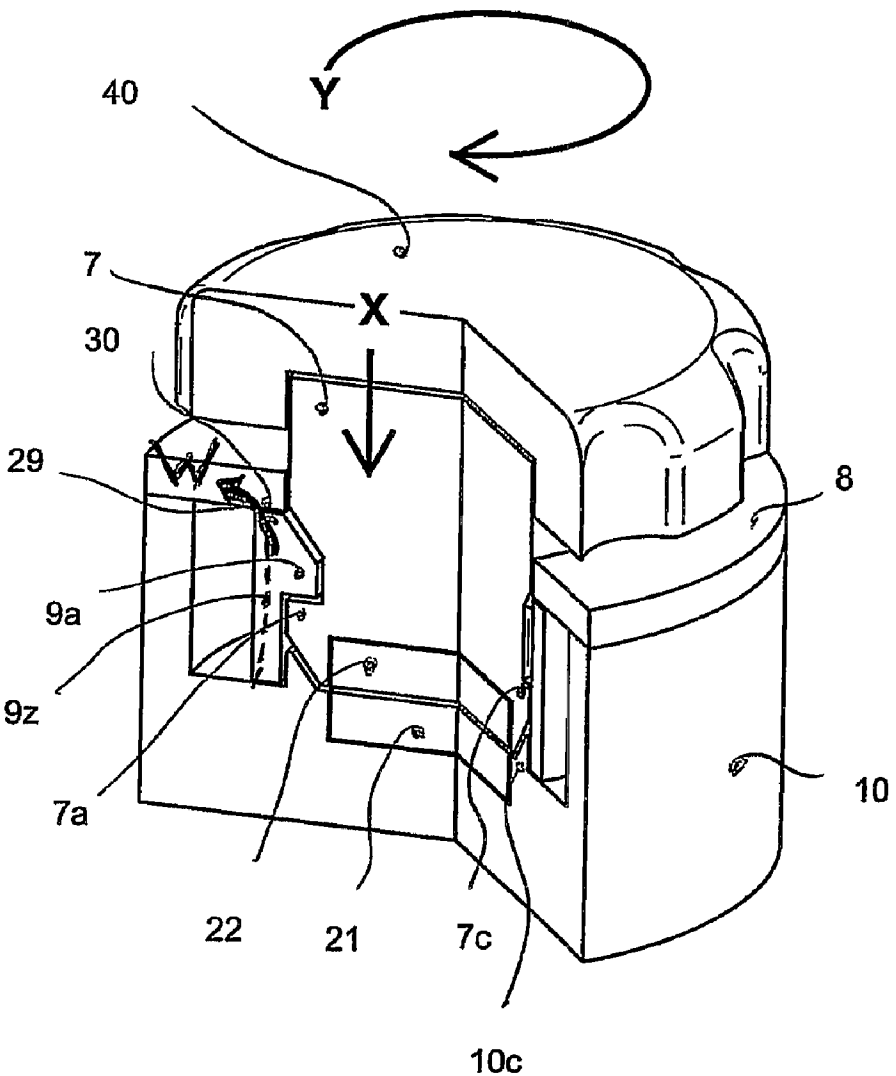

FIG. 8*d* shows the closure in closing position, where the locking pieces 7*a*, 7*c* and the engaging protrusions 9*a*, 9*b* are positively locked.

When a loading force now acts against the closing direction X, the locking pieces 7*a*, 7*c* press on the engaging protrusions 9*a*, 9*b*. Under great load, the engaging protrusions now want to back away in the direction W and bend the spring 9*z*, as indicated with the broken line. However, since the spring 9*z* already is bent in one direction and an unelastic surface can only be bent in one direction, it now is particularly flexurally rigid in the loading direction opposite to the direction X. The closure thus can withstand a particularly great load, so that it can also be built very small with good strength values and can also be built at low cost, since the magnets can be dimensioned small.

Figure 8E:
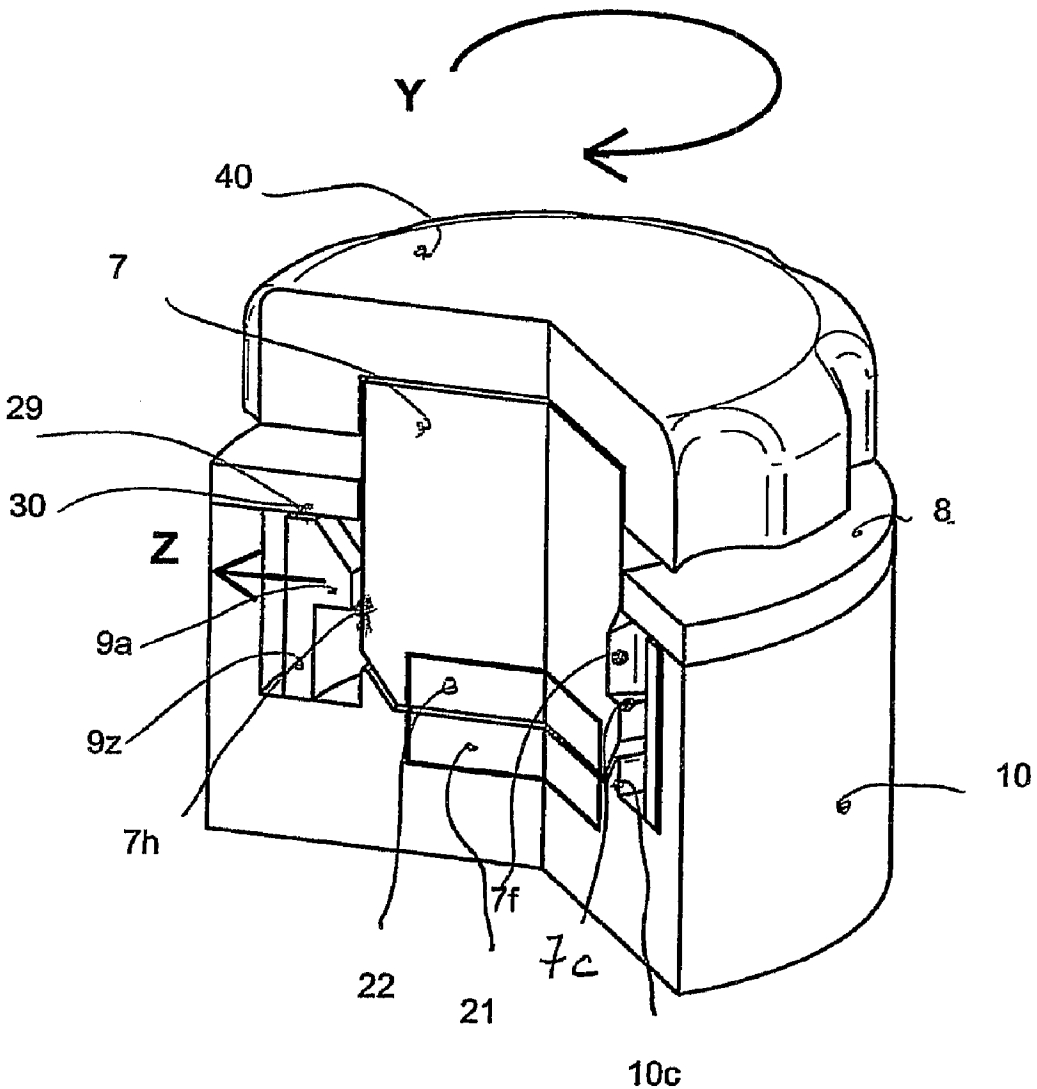

Next, the connection module 1 now is rotated with the rotary knob 40 axially in direction Y to such an extent that the functional phase according to FIG. 8*e* is reached, in which the connection module 1 has been rotated to such an extent that the engaging protrusions 9*a*, 9*b* of the spring locking element 9 have been urged back by the wedge-shaped bevels 7*h*, 7*e* and hence are out of engagement with the locking pieces 7*a*, 7*c*. The closure can now be opened.

Figure 9A:
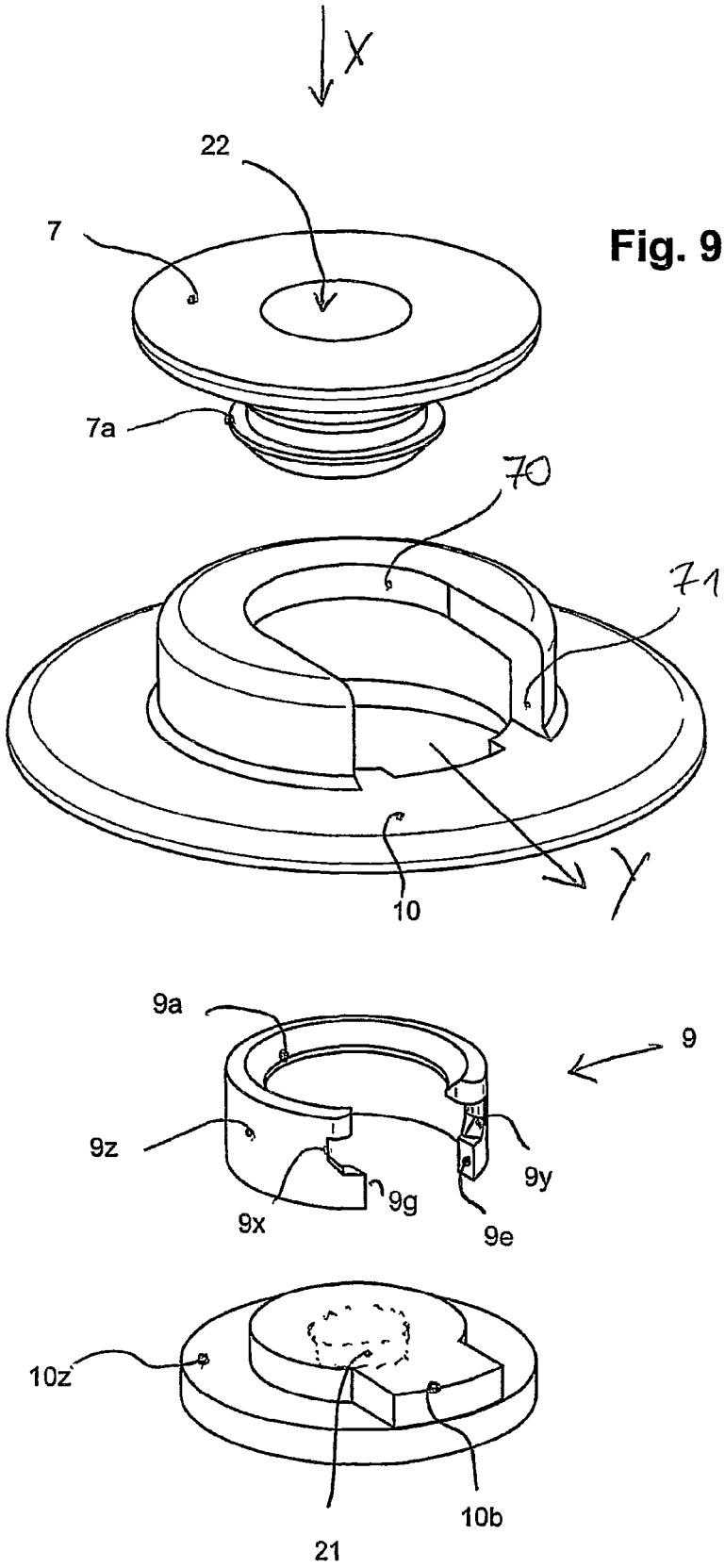
FIGS. 9*a-d* show another embodiment of a closure.

FIG. 9*a* shows an exploded representation of a sliding snap-action closure of the invention according to claim 1.

A first connection module consists of: a plug 7, a magnet 22 and a locking piece 7*a* which is formed as a circumferential edge.

A second connection module consists of:

- the housing 10 with the closing opening 70 for closing the connection modules in direction X and with the opening 71 for pushing the plug 7 out in direction Y,
- the spring locking element 9 consisting of a strip-shaped spring 9*z* bent axially to the direction X, the circumferential engaging protrusion 9*a* and the end faces 9*g* and 9*e* with which the spring supports on the protrusion 10*b*,
- the housing bottom 10*z* with protrusion 10*b*, and
- keeper or second magnet 21.

Figure 9B:
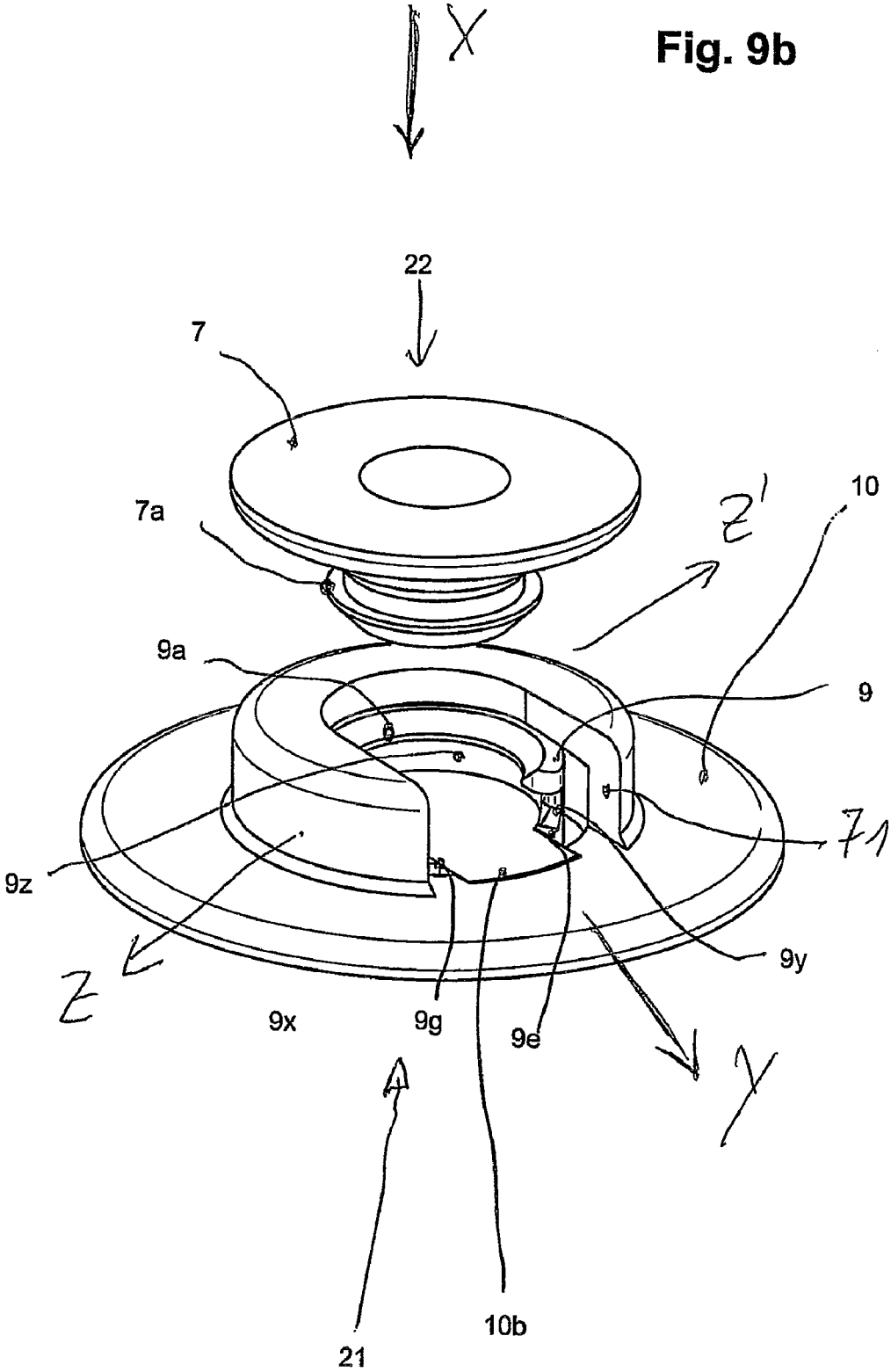

FIG. 9*b* shows a perspective view of the open closure. Closing proceeds as follows: the magnet-keeper construction 21, 22 pulls the plug 7 through the closing opening 70 into the housing 10. In the process, the locking piece 7*a* pushes the spring locking element 9 to the side due to the magnetic force. When snapping into place, it is spread in direction Z and Z'.

The spring 9*z* satisfies the dual function in accordance with the invention, analogous to the embodiment according to FIGS. 1*a-g* and FIG. 2:

Since on spreading in direction Z the spring is bent further in the same direction of bending, it is flexurally soft when snapping into place, i.e. the magnet-keeper system can be relatively weak, in order to satisfy the requirement to automatically pull the closure together. When applying a load on the closure against the direction X, however, the spring 9*z* is very much flexurally rigid, as shown in FIG. 2, and the closure thereby is positively locked very reliably.

Figure 9C:
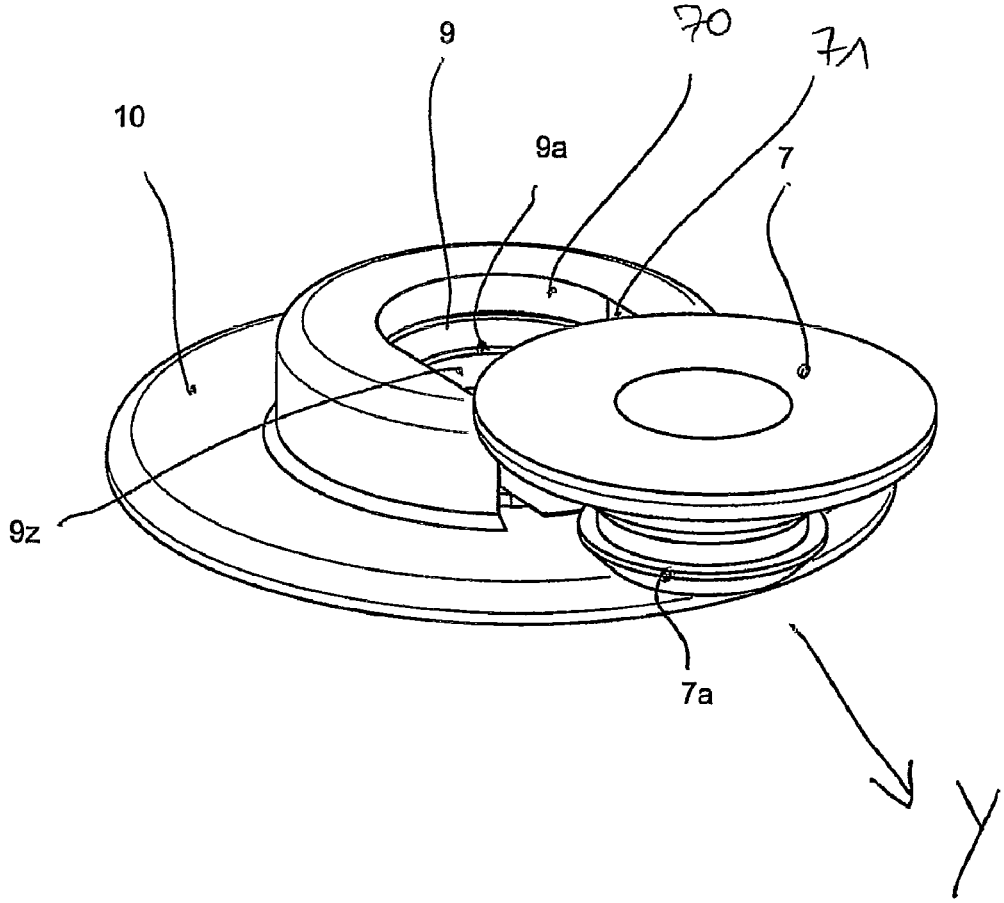

For opening, the plug is now linearly shifted through the opening 71 in direction Y, as shown in FIG. 9*c*, without the spring being pushed to the side. Thus, the closure opens particularly comfortably.

Figure 9D:
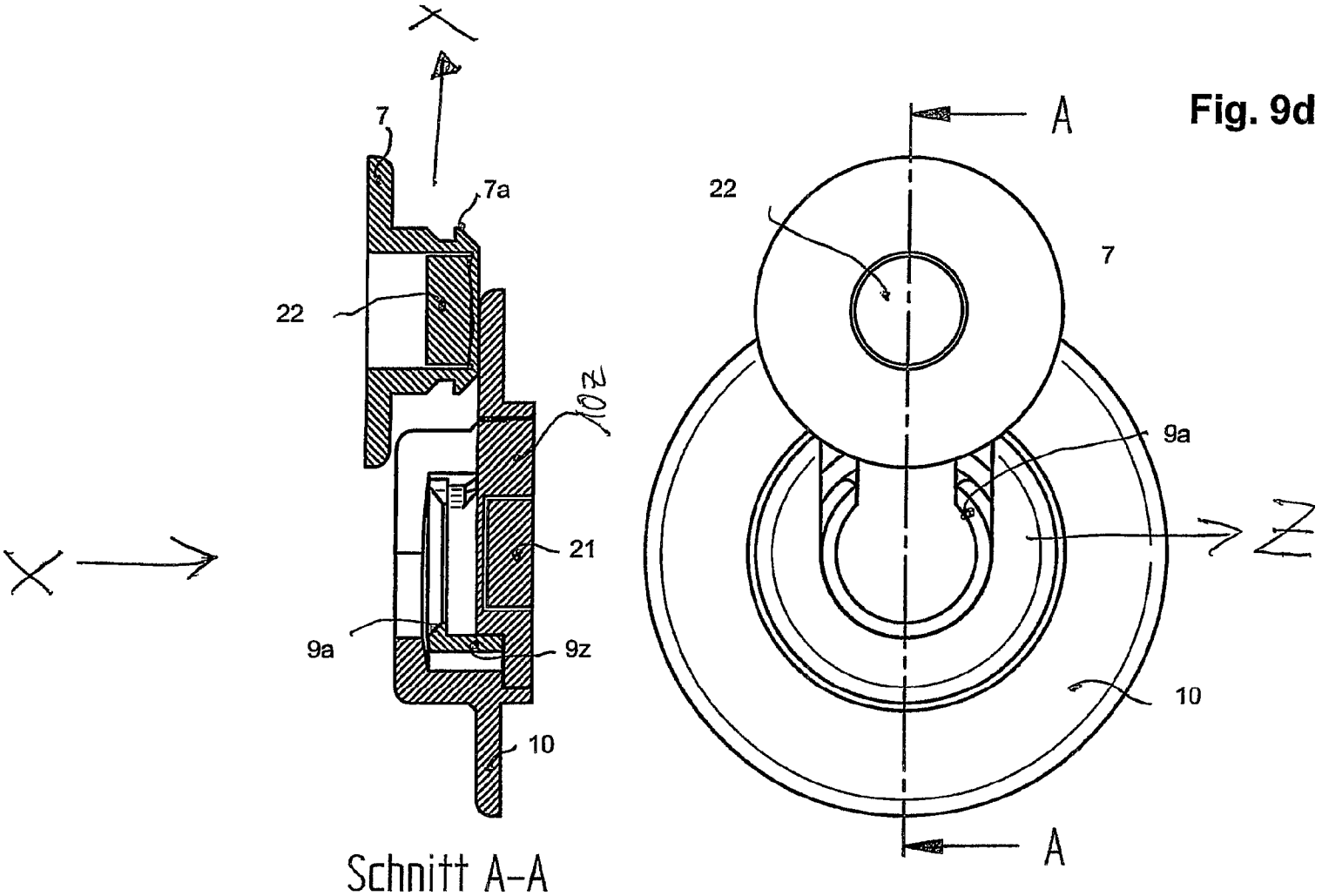
Figure 10A:
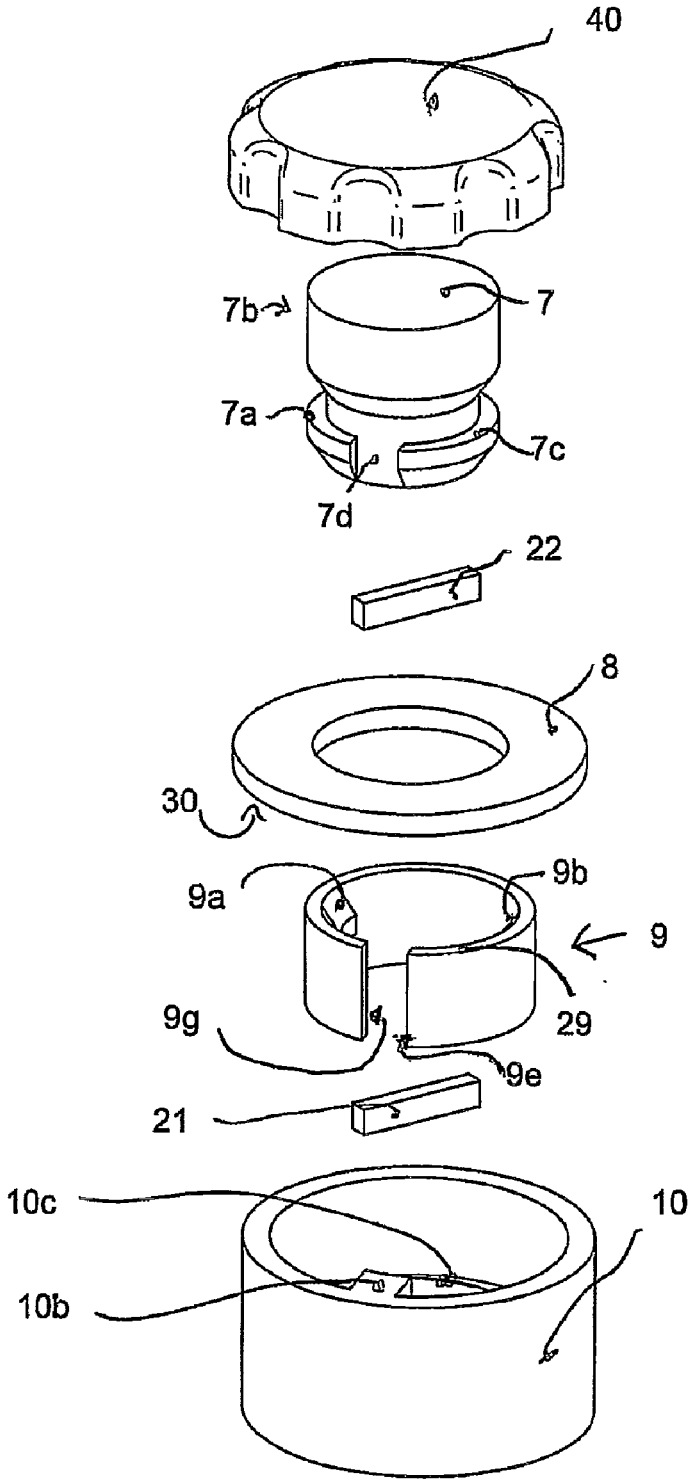
FIGS. 10*a-g* show another embodiment of a closure.
Figure 10B:
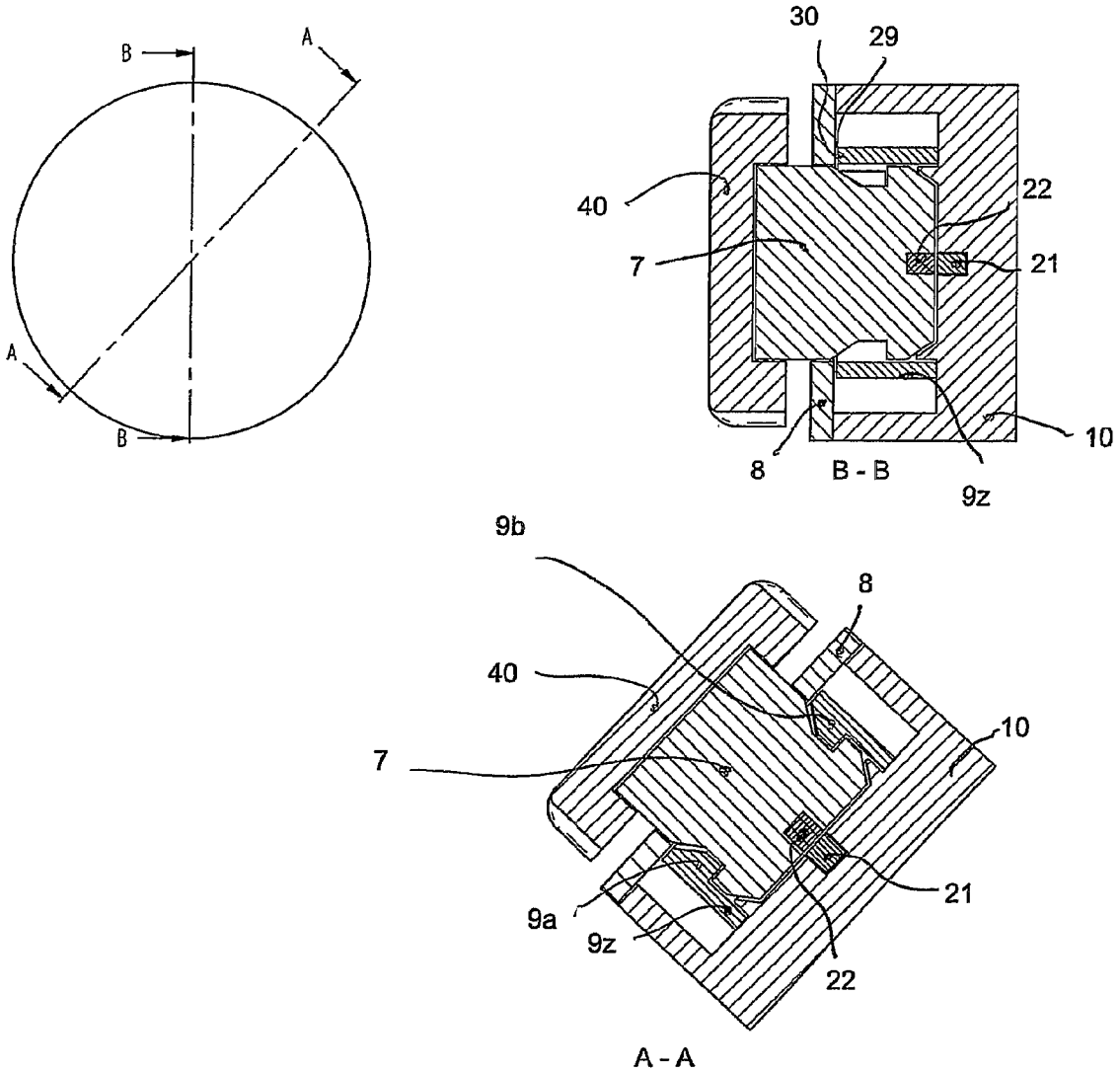
Figure 10C:
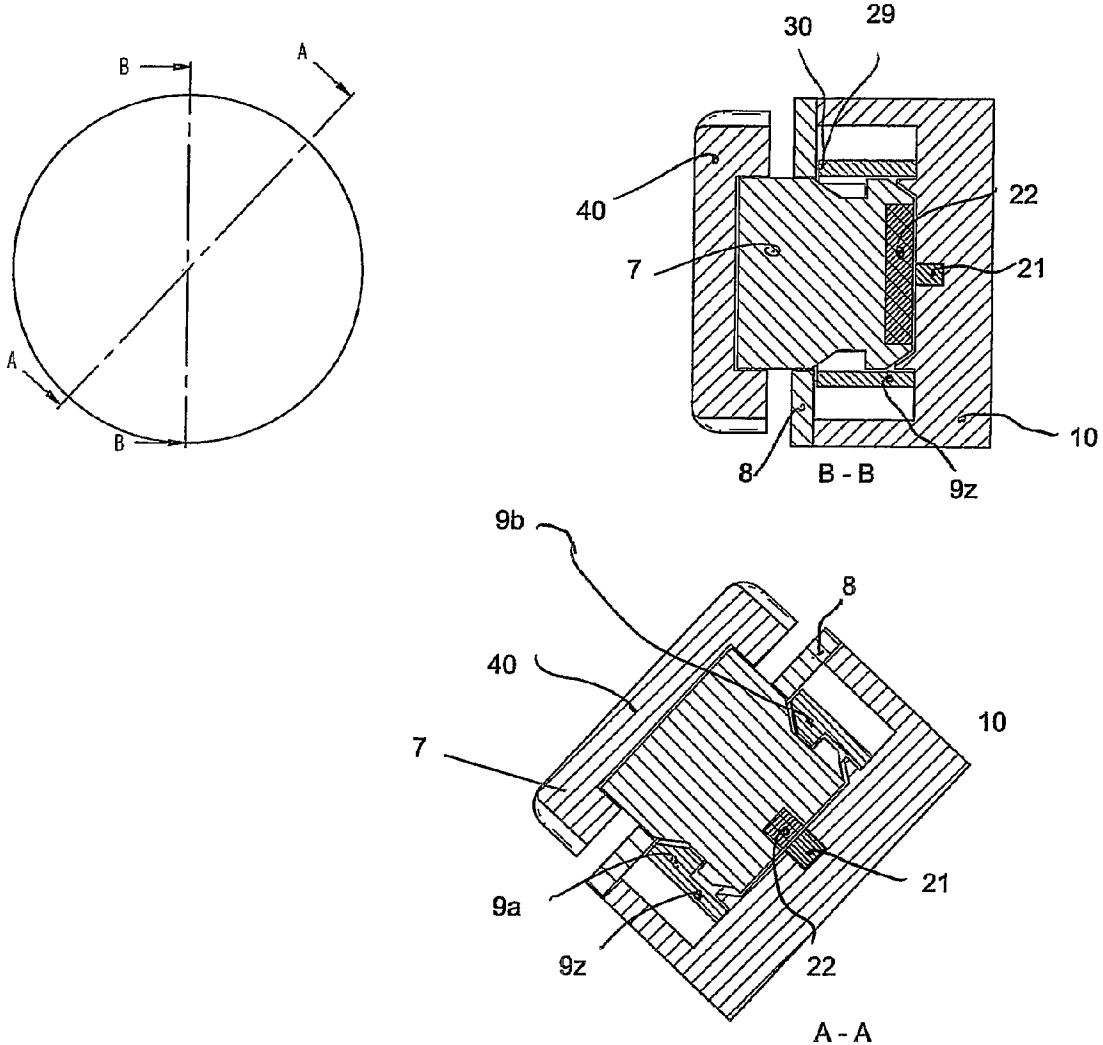
Figure 10D:
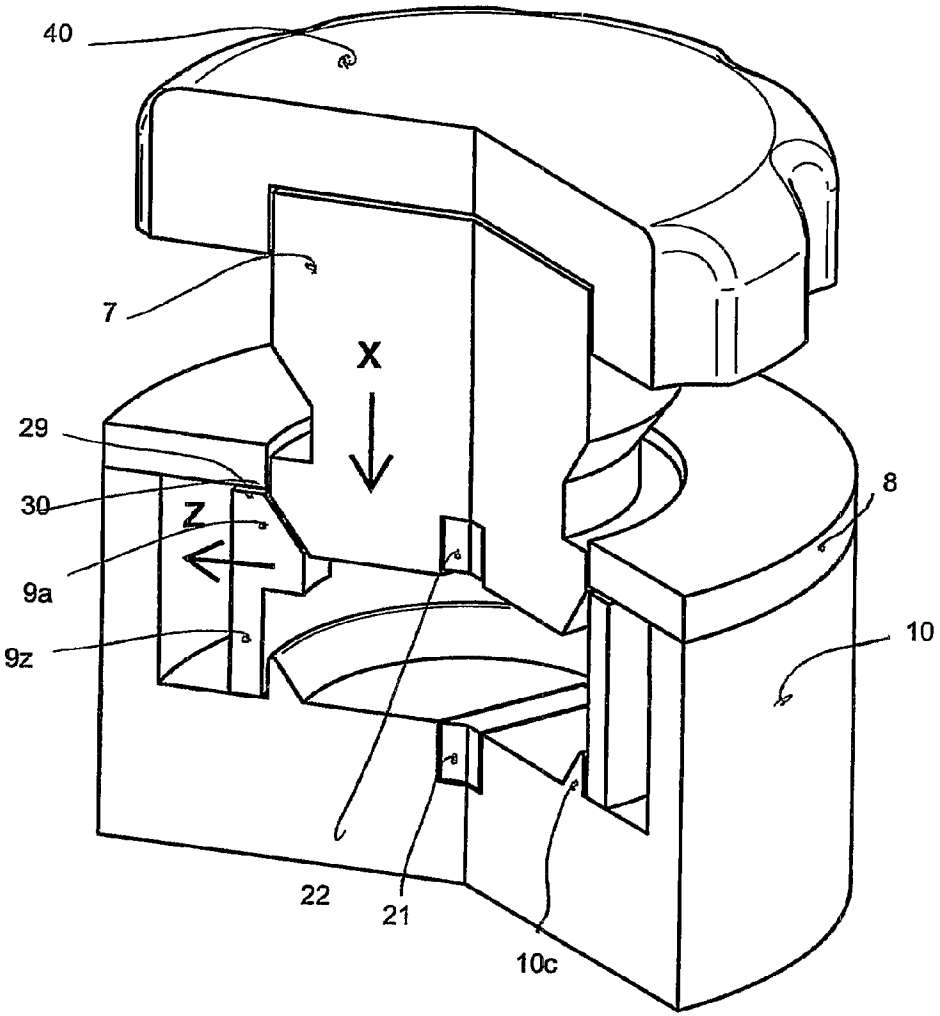
Figure 10E:
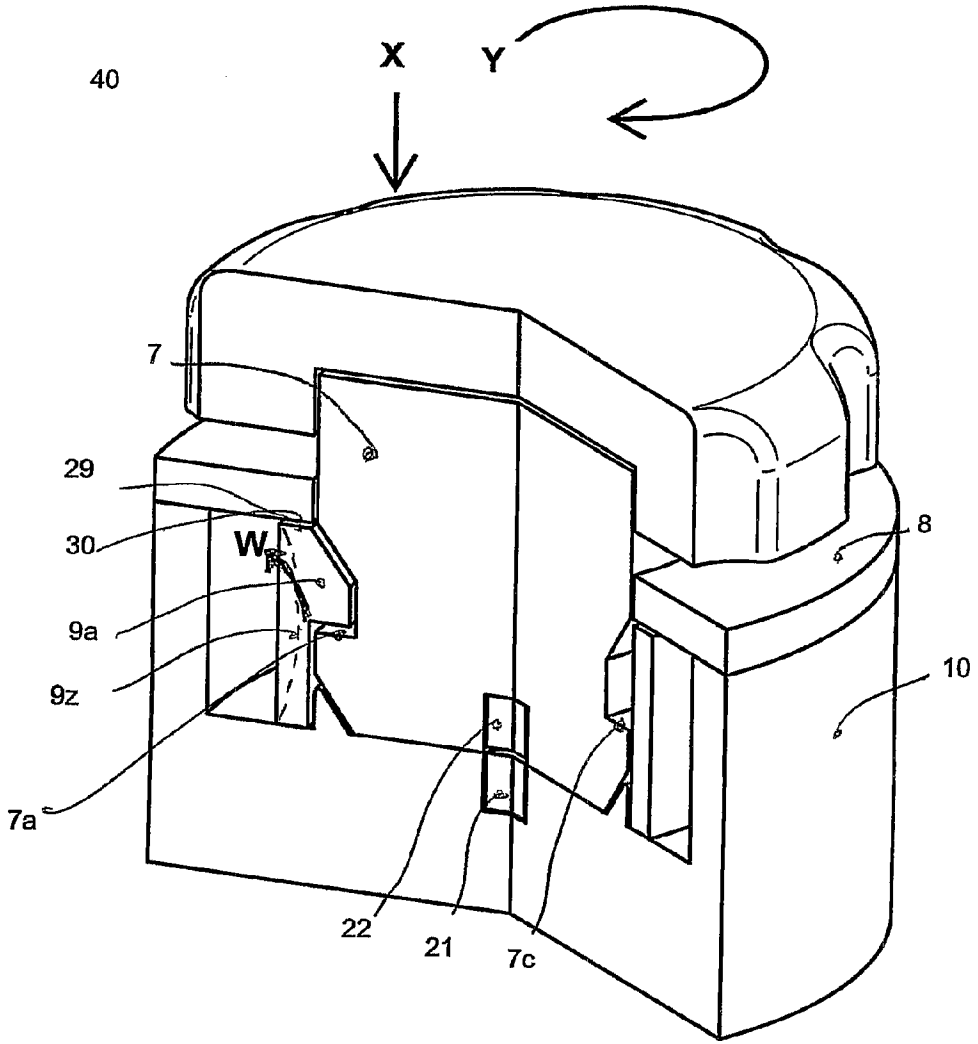
Figure 10F:
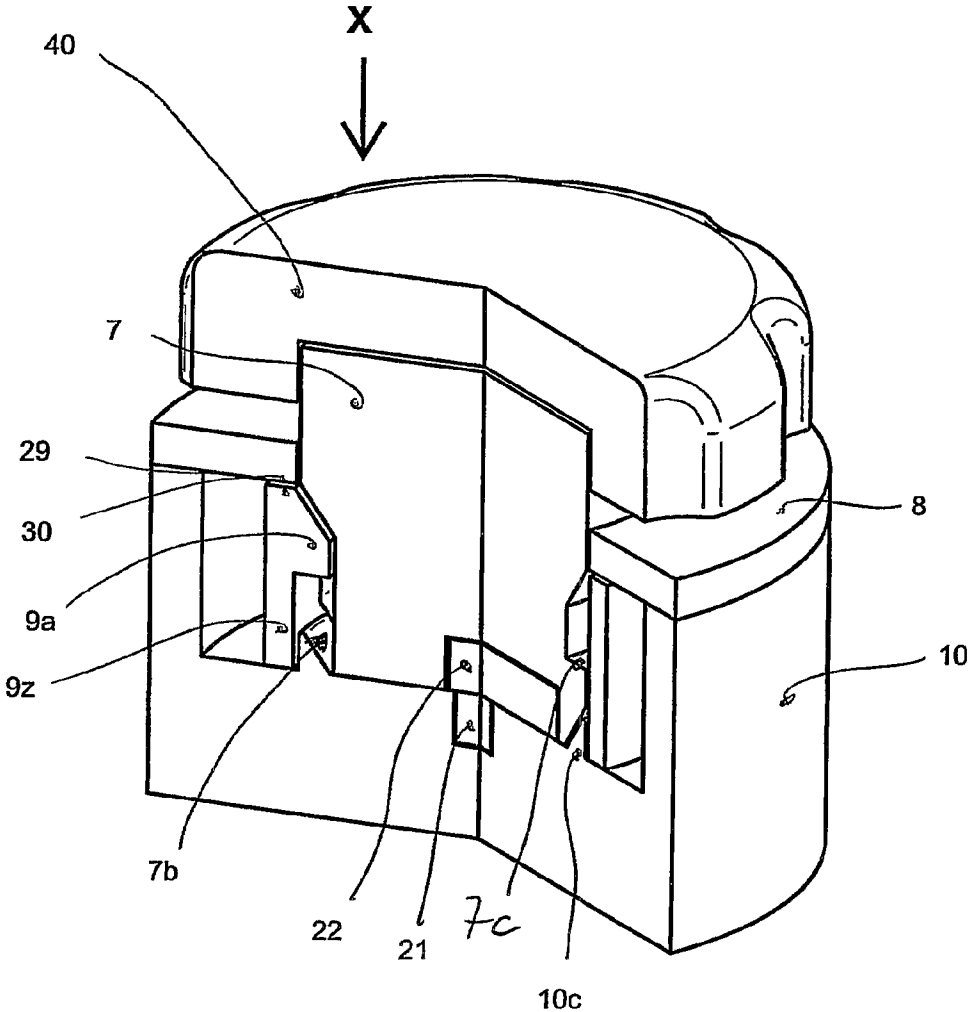
Figure 10G:
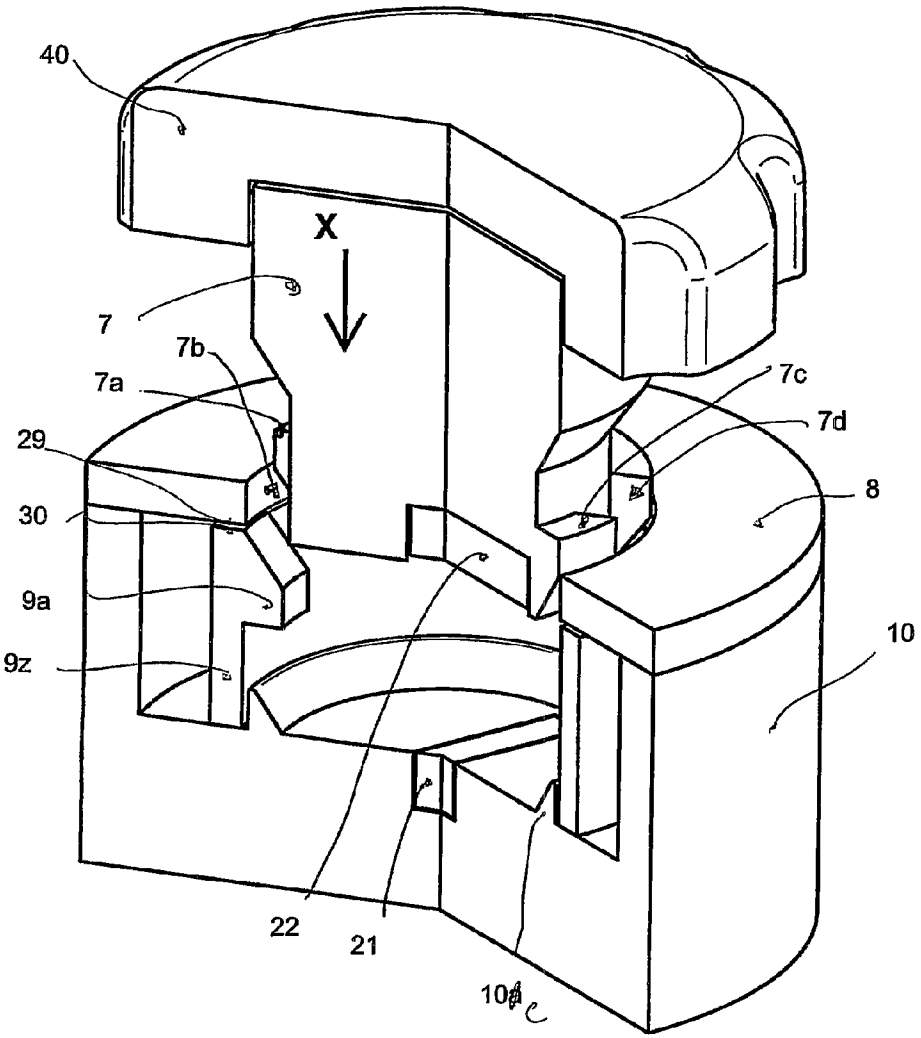

FIG. 9*d* shows a sectional view with the closure after opening, with the plug 7 shifted in direction Y and the housing 10.

An advantageous development exists when the space between the recesses 9*x*, 9*y* of the spring 9*z* for laterally pushing out the locking piece 8*a* is not as broad as the locking piece, but slightly smaller, so that the closure must be opened with a predetermined force against a slight spreading of the spring. Then, the closure will hold particularly safely. This development is a hybrid solution so to speak between a closure according to the generic part of claim 1 and according to the generic part of claim 2.

Magnetic Systems

A development in accordance with the invention as claimed in claim 7 exists when the spring locking element 9 configured as separate component is kept centered with the inner stop 10*c*, when the closure is opened. This promotes a safe snapping into place. All embodiments shown in FIGS. 1*a-g*, 2, 3, 6, 7, 9*a-e*, 10*a-g* are provided with this inner stop. The meander spring as shown in FIG. 5 can be guided both by an inner stop and by an outer stop.

The skilled person also knows of other means how to hold an annular spring movably, but in a centered position, such as the fixation by means of e.g. three elastic pins.

Analogous to the views and phases of movement shown in FIGS. 1*a-g*, FIGS. 10*a-g* show a closure in accordance with the invention as claimed in claim 1 and claim 9.

The only difference to the embodiment as shown in FIGS. 1*a-g* consists in that after a rotation in direction Y the magnetic system comprising two bar-shaped magnets 21, 22 has less overlap surface (cf. FIG. 10*b* A-A and FIG. 10*c* A-A) and as a result the force of attraction of the magnets is reduced on opening, which provides for a particularly easy opening.

Analogous to the views and phases of movement shown in FIGS. 1*a-g*, FIGS. 11*a-g* show a closure in accordance with the invention as claimed in claim 1 and claim 10.

Figure 11A:
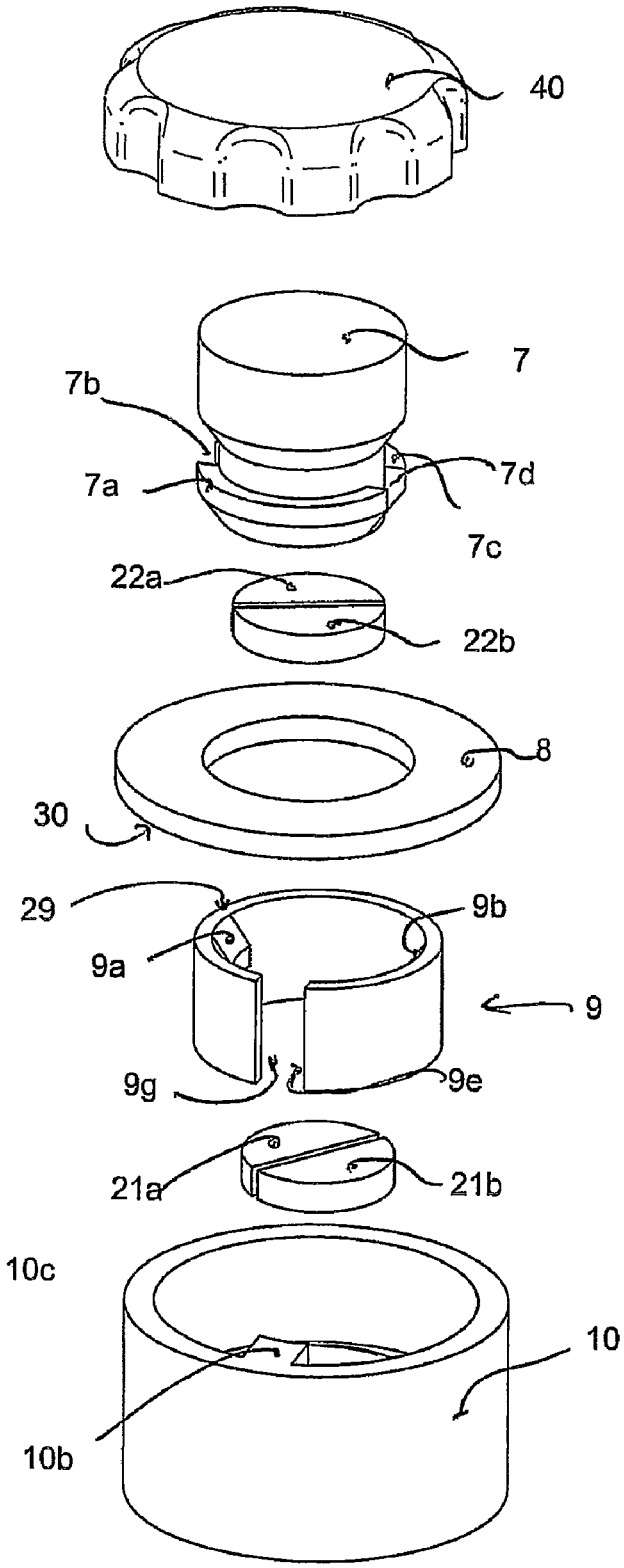
FIGS. 11*a-g* show yet another embodiment of a closure.
Figure 11B:
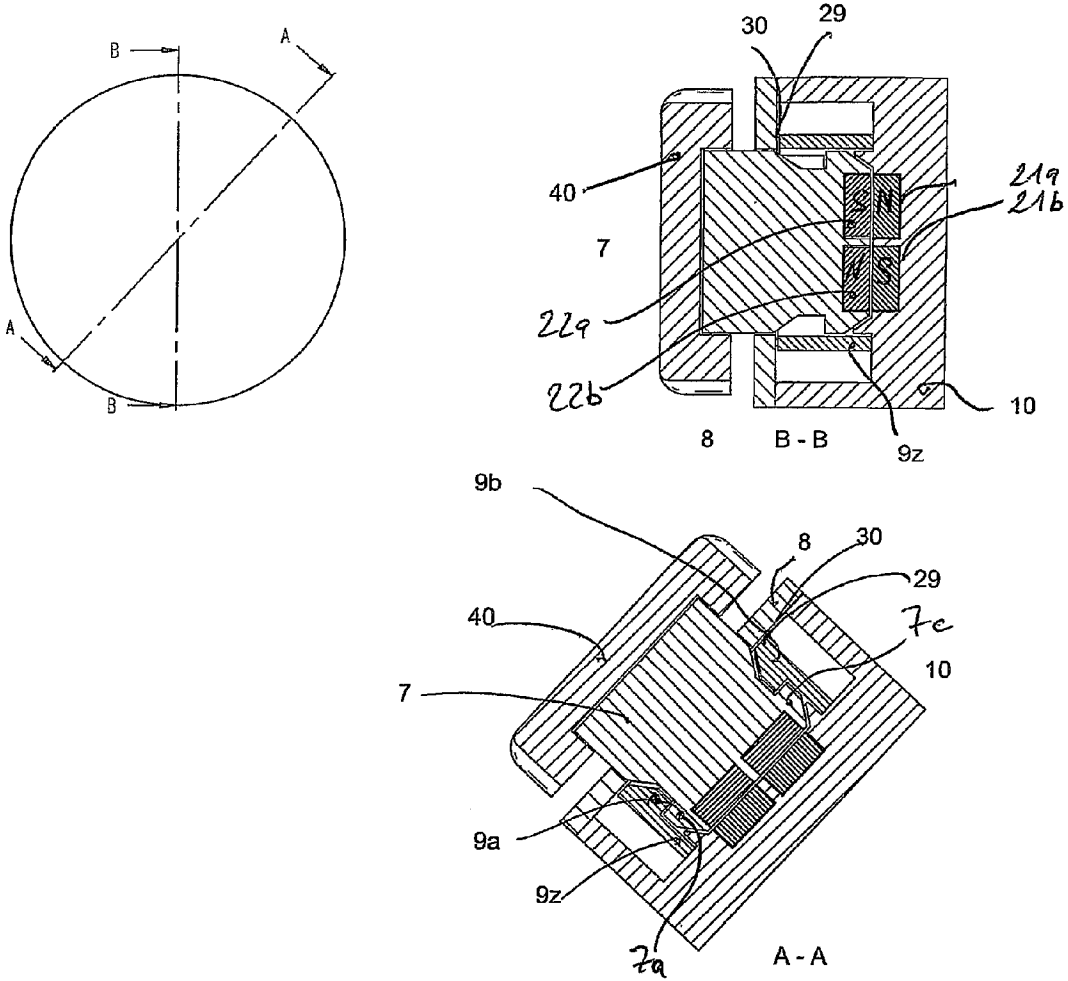
Figure 11C:
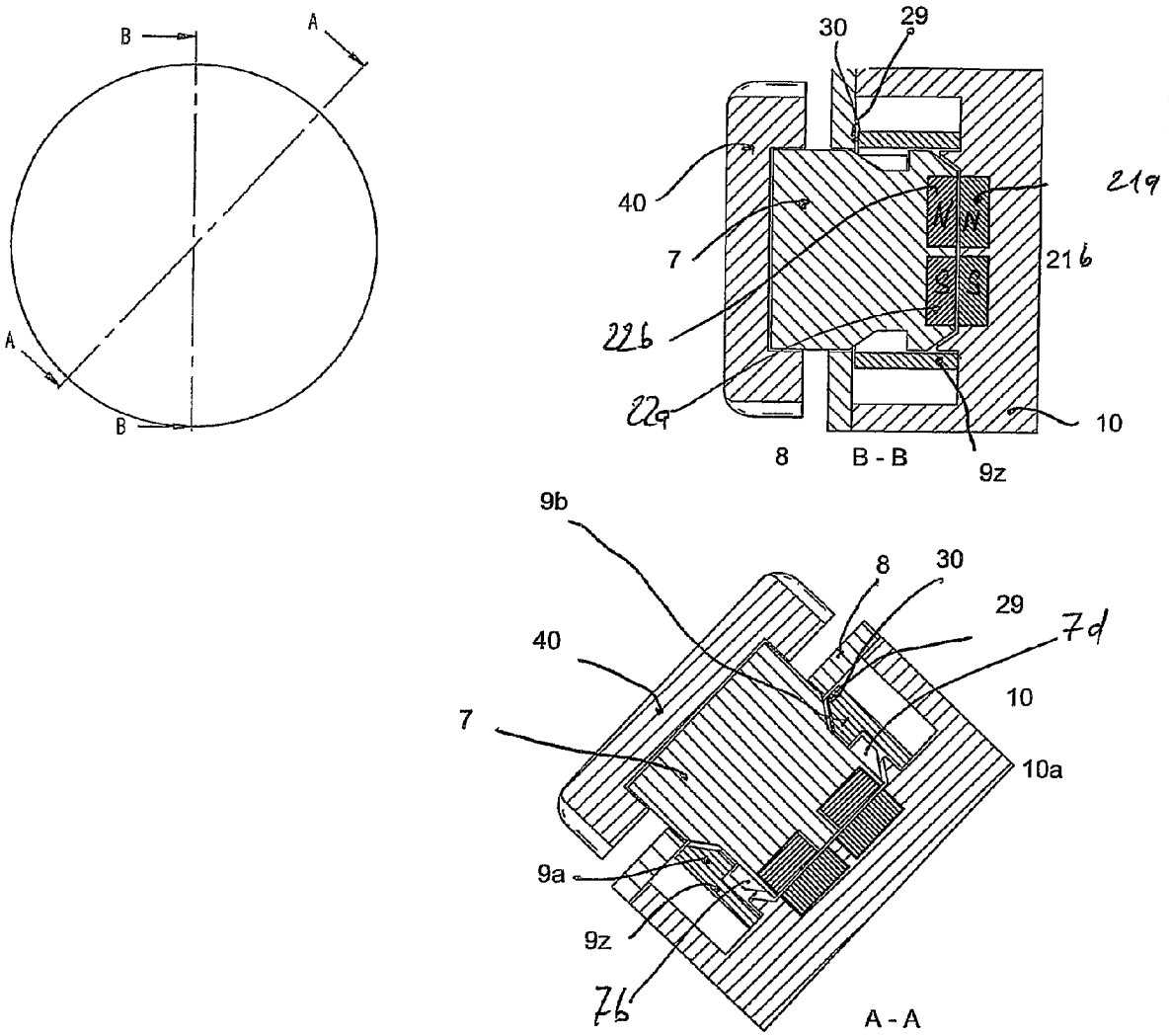
Figure 11D:
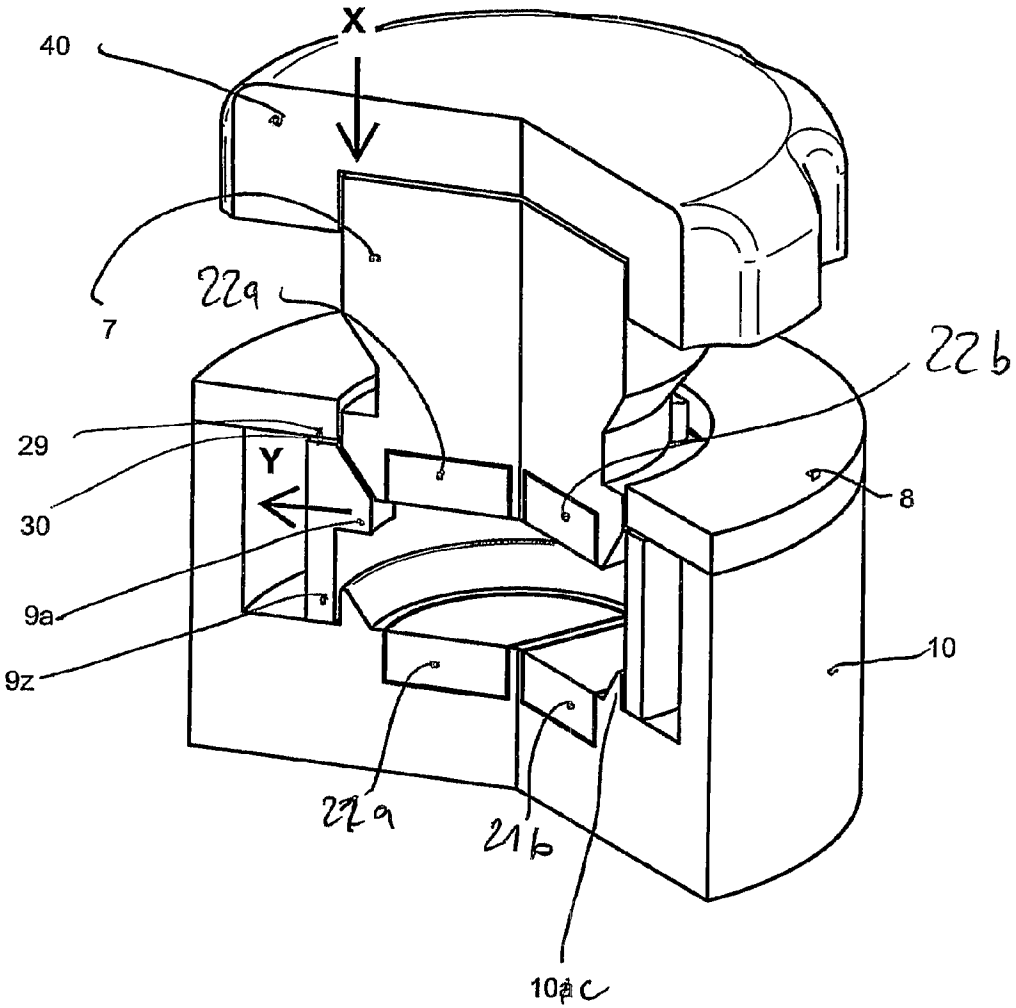
Figure 11E:
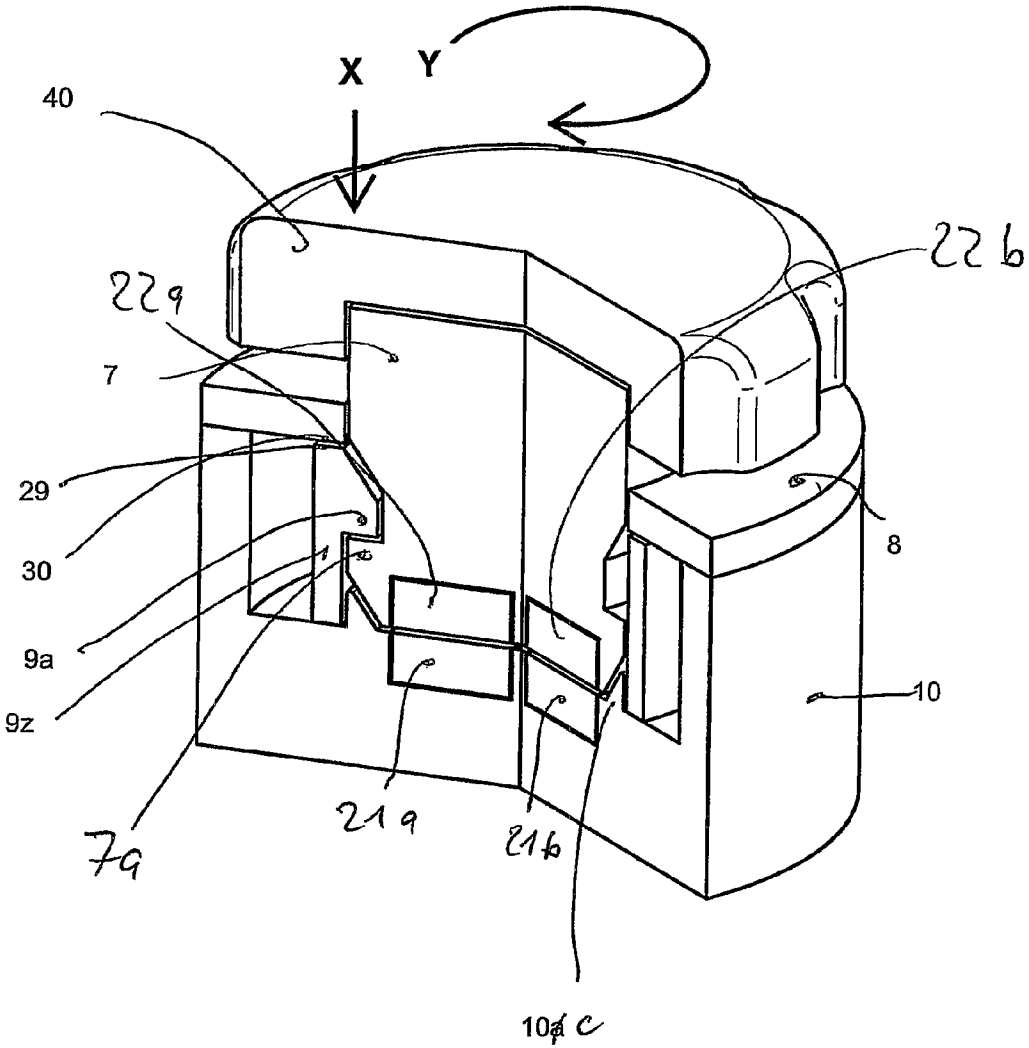
Figure 11F:
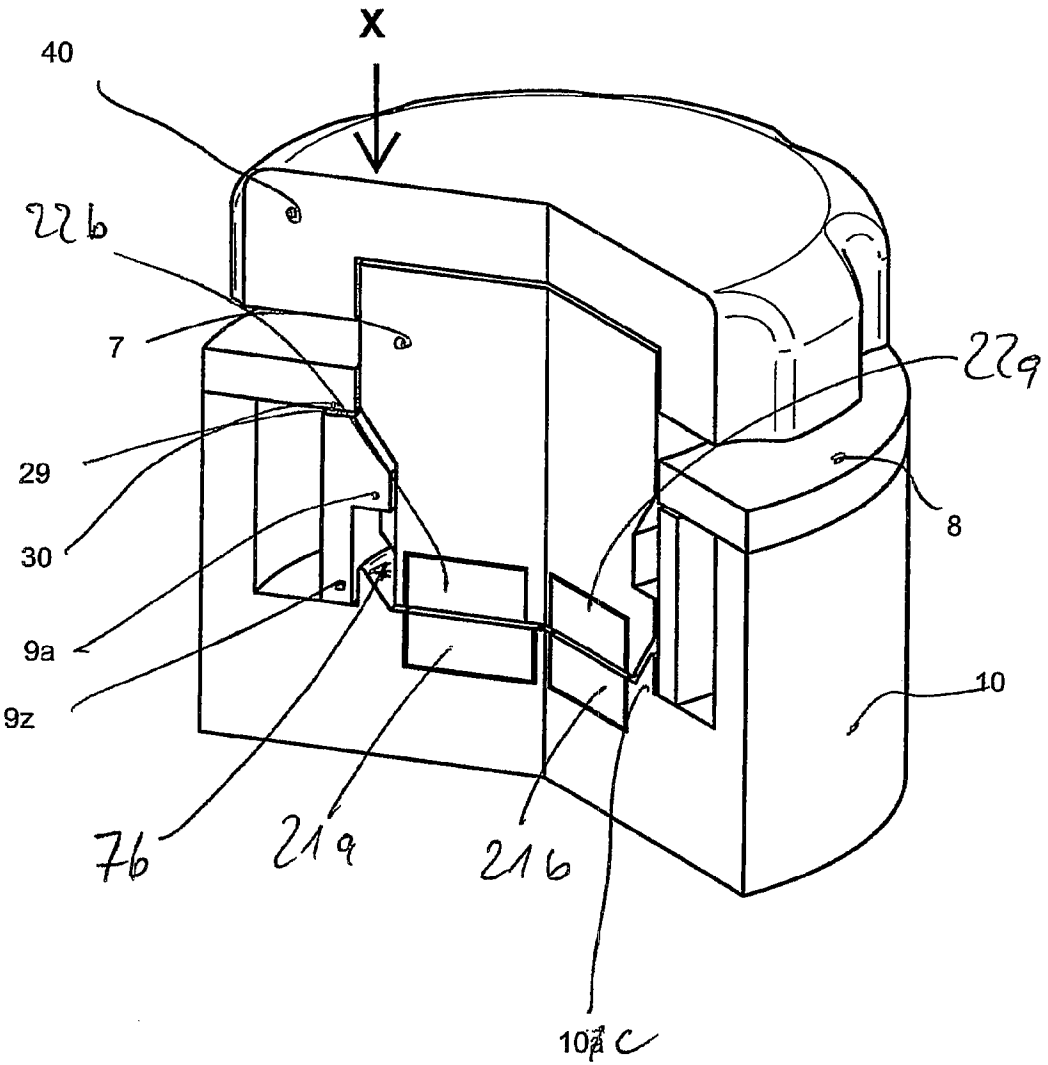
Figure 11G:
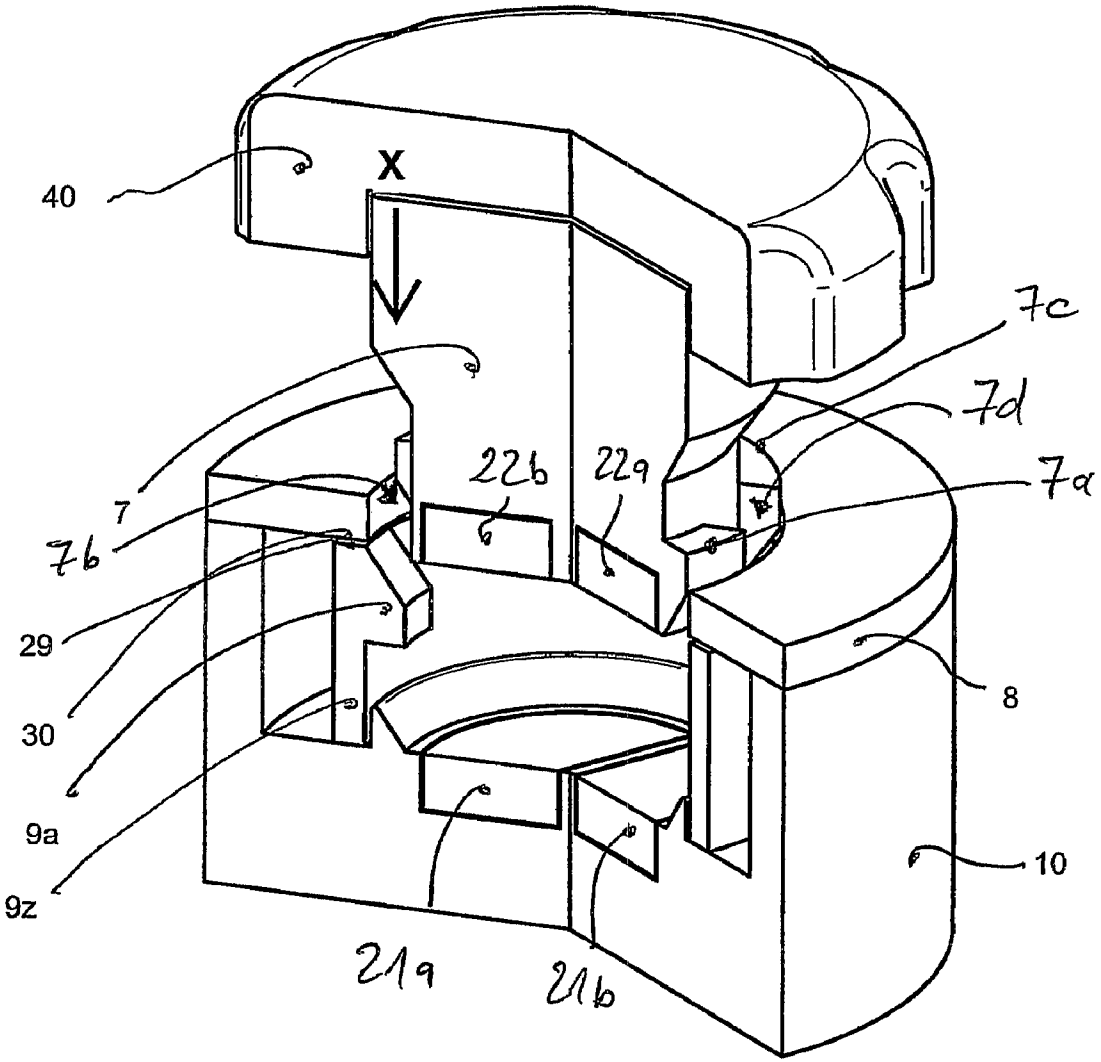

The only difference to the embodiment as shown in FIGS. 1*a-g* consists in that the magnet-keeper system consists of four magnets 21*a*, 21*b*, 22*a*, 22*b*. In the closing position as shown in FIG. 11*e*, the same face each other in an attracting manner and after rotation in direction Y face each other in a repelling manner (cf. FIG. 11*b* A-A and FIG. 11*c* A-A) and as a result the force of attraction of the magnets is reduced on opening, which provides for a particularly easy opening, since on opening the closure will pop open on its own.

The developments as shown in FIGS. 10*a-g* and 11*a-g* with attenuatable or polable magnetic systems in addition have the advantage that due to their tendency to align each other in an opposed position of attraction the magnets effect repositioning of the closure.

According to claim 11, repositioning is effected by means of a weight, for example on the rotary knob 40. Alternatively, repositioning is effected by means of a spring, when the rotary part 7 is movably mounted in a further component.

The invention claimed is:

1. A locking magnet closure, consisting of a first closure module and a second closure module with the following features:

a magnet-keeper construction with at least one magnet in the first closure module and a keeper or second magnet in the second closure module, wherein on closing the magnet-keeper construction pulls the first closure module and the second closure module together in a closing direction, for opening, the first closure module and the second closure module are rotatable or shiftable in an opening direction laterally to the closing direction, a locking device for positively locking the closure modules between the first closure module and the second closure module, comprising at least one spring locking element, which consists of an engaging protrusion and a spring and is arranged in the first closure module, and a locking piece, which is arranged in the second closure module, wherein on closing the locking piece pushes the spring locking element to the side in a third direction and then positively snaps into place with the engaging protrusion, and wherein on shifting or rotating the first closure module and the second closure module in the opening direction the locking piece and the spring locking element are rotated or shifted against each other from an engagement position, in which locking piece and spring locking element are in engagement, into a non-engagement position, in which locking piece and spring locking element are not in engagement, without the spring locking element being pushed to the side, wherein the magnet-keeper construction is dimensioned such that on closing the locking device is automatically closed by the magnetic force of the magnet-keeper construction, wherein the spring of the spring locking element is formed and arranged such that it has a dual function, namely that on closing the spring deflects flexurally soft in the third direction, but when applying a load on the closure against the closing direction, the spring is flexurally rigid.

2. A locking magnet closure, consisting of a first closure module and a second closure module with the following features:

a magnet-keeper construction with at least one magnet in the first closure module and a keeper or second magnet in the second closure module, wherein on closing the magnet-keeper construction pulls the first closure module and the second closure module together in a closing direction, for opening, the first closure module and the second closure module are rotatable or shiftable against each other in an opening direction laterally to the closing direction, a locking device for positively locking the closure modules between the first closure module and the second closure module, comprising at least one spring locking element, which consists of an engaging protrusion and a spring and is arranged in the first closure module, a locking piece which is arranged in the second closure module, and a wedge connected with the second closure module and the locking piece, wherein on closing, the locking piece pushes the spring locking element to the side in a third direction and then positively snaps into engagement, and wherein on shifting or rotating the first closure module and the second closure module in the opening direction the spring locking element is gradually pushed to the side by means of the wedge from an engagement position, in which the locking piece and the spring locking element are in engagement, into a non-engagement position, in which the locking piece and the spring locking element no longer are in engagement with each other, wherein the magnet-keeper construction is dimensioned such that on closing the locking device is automatically closed by the magnetic force of the magnet-keeper construction, wherein the spring of the spring locking element is formed and arranged such that it has a dual function, namely that on closing, the spring deflects flexurally soft in the third direction, but when applying a load on the closure against the closing direction the spring is flexurally rigid.

3. The locking magnet closure according to claim 1 or 2, wherein the spring of the spring locking element is a resilient strip bent axially to the closing direction.

4. The locking magnet closure according to claim 1 or 2, wherein the spring of the spring locking element is a resilient strip repeatedly kinked parallel to the closing direction.

5. The locking magnet closure according to claim 1 or 2, wherein the spring is a strip bent or kinked meandrously to and fro.

6. The locking magnet closure according to claim 1 or 2, wherein the spring includes one or more resilient joints or resilient joint-like thin portions with a joint axis in the direction.

7. The locking magnet closure according to claim 1 or 2, wherein the spring is configured as a separate component and in the open position is held centered in the second closure module by means of one or more inner stops.

8. The locking magnet closure according to claim 1 or 2, wherein the spring is configured as a separate component and in the open position is held centered in the second closure module by means of one or more outer stops.

9. The locking magnet closure according to claim 1 or 2, wherein the magnet-keeper construction includes an attenuatable magnetic system.

10. The locking magnet closure according to claim 1 or 2, wherein the magnet-keeper construction includes a polable magnetic system.

11. The locking magnet closure according to claim 1 or 2, wherein a repositioning device is provided, which pushes the function elements shifted on opening the locking magnet closure back into their starting position.

* * * * *